US010815646B2

(12) United States Patent
White et al.

(10) Patent No.: US 10,815,646 B2
(45) Date of Patent: Oct. 27, 2020

(54) BOOM POTENTIAL ENERGY RECOVERY OF HYDRAULIC EXCAVATOR

(71) Applicant: Parker-Hannifin Corporation, Cleveland, OH (US)

(72) Inventors: Nicholas N. White, Shaker Heights, OH (US); James Howland, Mayfield Heights, OH (US); Hao Zhang, Twinsburg, OH (US); Blake Carl, University Heights, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 16/436,954

(22) Filed: Jun. 11, 2019

(65) Prior Publication Data

US 2019/0292752 A1 Sep. 26, 2019

Related U.S. Application Data

(62) Division of application No. 15/747,266, filed as application No. PCT/US2016/047052 on Aug. 15, 2016, now Pat. No. 10,358,797.

(Continued)

(51) Int. Cl.
*F15B 1/02* (2006.01)
*E02F 9/22* (2006.01)

(Continued)

(52) U.S. Cl.
CPC ..... *E02F 9/2217* (2013.01); *E02F 9/123* (2013.01); *E02F 9/2225* (2013.01);

(Continued)

(58) Field of Classification Search
CPC ..... F15B 1/0247; F15B 13/021; F15B 21/14; E02F 9/2217; E02F 9/2225
See application file for complete search history.

(56) References Cited

U.S. PATENT DOCUMENTS 7,434,391 B2 * 10/2008 Asam ..... E02F 9/2217 60/414
8,186,154 B2 5/2012 Nelson et al.

(Continued)

FOREIGN PATENT DOCUMENTS

CN 101321642 12/2008
CN 101845837 9/2010

(Continued)

OTHER PUBLICATIONS

Fluid Power Transmission and Control, No. 2(Serial No. 63), Mar. 2014, English abstract and pp. 6-7.

(Continued)

*Primary Examiner* — Thomas E Lazo
(74) *Attorney, Agent, or Firm* — Renner, Otto, Boisselle & Sklar, LLP

(57) ABSTRACT

A hydraulic system for recovering potential energy of a load implement of a mobile construction vehicle. The hydraulic system includes first and second actuators and control valving. The first and second actuators are configured to be coupled to the load implement for controlling raising and lowering of the load element. The control valving is operable between a first position at which, during a lowering of the load implement, the control valving directs hydraulic fluid from one of the first and second actuators to an accumulator to charge the accumulator, and a second position at which the control valving directs hydraulic fluid from the accumulator to one or more of the first and second actuators to power the one or more of the first and second actuators to raise the load element.

12 Claims, 18 Drawing Sheets

Related U.S. Application Data

(60) Provisional application No. 62/205,307, filed on Aug. 14, 2015.

(51) Int. Cl.

| | |
|---|---|
| ***E02F 9/12*** | (2006.01) |
| ***F15B 13/02*** | (2006.01) |
| ***F15B 13/06*** | (2006.01) |
| ***F15B 21/14*** | (2006.01) |

(52) U.S. Cl.

CPC ..... *E02F 9/2267* (2013.01); *E02F 9/2271* (2013.01); *F15B 1/024* (2013.01); *F15B 13/021* (2013.01); *F15B 13/06* (2013.01); *F15B 21/14* (2013.01); *E02F 9/2292* (2013.01); *E02F 9/2296* (2013.01); *F15B 2211/20546* (2013.01); *F15B 2211/20576* (2013.01)

(56) References Cited

U.S. PATENT DOCUMENTS

| | | | | |
|---|---|---|---|---|
| 8,943,819 | B2 * | 2/2015 | Knussman | F15B 7/006 60/421 |
| 9,194,107 | B2 * | 11/2015 | Andruch, III | E02F 9/2217 |
| 9,593,467 | B2 * | 3/2017 | Kajita | E02F 9/2217 |
| 2005/0229594 | A1 | 10/2005 | Nanjo | |
| 2009/0025379 | A1 | 1/2009 | White | |
| 2009/0036248 | A1 | 2/2009 | Mueller et al. | |
| 2010/0236232 | A1 | 9/2010 | Boehm et al. | |
| 2013/0133966 | A1 | 5/2013 | Jiang et al. | |
| 2013/0333378 | A1 | 12/2013 | Wen | |
| 2013/0340418 | A1 * | 12/2013 | Wen | F15B 1/024 60/327 |
| 2014/0119867 | A1 * | 5/2014 | Wen | E02F 9/123 414/687 |
| 2014/0166114 | A1 | 6/2014 | Wang et al. | |
| 2016/0273192 | A1 * | 9/2016 | Kajita | E02F 9/2267 |

FOREIGN PATENT DOCUMENTS

| | | |
|---|---|---|
| CN | 202926765 | 5/2013 |
| CN | 103148031 | 6/2013 |
| DE | 102007012116 | 9/2010 |
| EP | 2570381 | 3/2013 |
| EP | 2589823 | 8/2013 |
| EP | 2853755 | 1/2015 |
| EP | 2853755 | 3/2017 |

OTHER PUBLICATIONS

First Office Action in corresponding Chinese patent application No. 2016800484736, including English translation and original, dated Nov. 5, 2019.

U.S. Appl. No. 14/370,795.

Fan Ji et al., "Energierueckgewinnung am drehwerksantrieb eines hydrobaggers, O + P olhydraulik und pneumatik", Vereinigte fachverlage, Mainz, DE, vol. 37, No. 3, Mar. 1, 1993, pp. 190-192 and 194.

First Office Action in corresponding Chinese patent application No. 2016800484736, dated Nov. 5, 2019.

* cited by examiner

BOOM POTENTIAL ENERGY RECOVERY OF HYDRAULIC EXCAVATOR

RELATED APPLICATIONS

This application is a divisional of U.S. patent application Ser. No. 15/747,266, filed on Jan. 24, 2018, which is a national phase of International Patent Application Serial No. PCT/US2016/047052, filed on Aug. 15, 2016, which claims the benefit of U.S. Provisional Patent Application No. 62/205,307, filed Aug. 14, 2015, which are hereby incorporated herein by reference.

FIELD OF INVENTION

The present invention relates generally to energy recovery and, more particularly to a system and method for accumulating and using recovered hydraulic energy. The invention has particular application for mobile construction vehicles such as excavators.

BACKGROUND

Excavators are an example of construction machines that use multiple hydraulic actuators to accomplish a variety of tasks. These actuators are fluidly connected to a pump that provides pressurized fluid to chambers within the actuators. This pressurized fluid force acting on the actuator surface causes movement of actuators and connected work tool. During operation of an excavator, the implement or load may be raised to an elevated position at which the implement gains potential energy. As the implement is released from the elevated position, the potential energy may be converted to heat when pressurized hydraulic fluid is forced out of the hydraulic actuator and is throttled across a hydraulic valve and returned to a tank. Recovering the wasted potential energy for reuse will improve the efficiency of the excavator. As the excavator starts to work, the boom cylinder piston can expand and contract twice during a work period as well as the arm cylinder and the bucket cylinder. Based on an analysis, the excess energy of the boom system accounts for around 47% of input energy among the three cylinder systems: boom, arm, and bucket cylinder systems. There remains a need in the art for a system that recovers the energy in a cost effective and efficient manner.

SUMMARY OF INVENTION

The present invention is directed to a hydraulic system that recovers and stores energy and reuses the energy to power system components, thereby reducing the power demand on the engine and enabling the engine to be reduced in size. According to one aspect of the invention, a hydraulic system for recovering potential energy of a load implement of a mobile construction vehicle, includes first and second actuators configured to be coupled to the load implement for controlling raising and lowering of the load element; and control valving that is operable between a first position at which, during a lowering of the load implement, the control valving directs hydraulic fluid from one of the first and second actuators to an accumulator to charge the accumulator, and a second position at which the control valving directs hydraulic fluid from the accumulator to one or more of the first and second actuators to power said one or more of the first and second actuators to raise the load element.

Embodiments of the invention may include one or more of the following additional features separately or in combination.

In the first position the control valving may direct hydraulic fluid from only the one actuator to the accumulator to charge the accumulator.

In the second position the control valving may direct hydraulic fluid from the accumulator to both the first and second actuators to power the first and second actuators to raise the load element.

In the second position the control valving may direct hydraulic fluid from the accumulator to only one of the first and second actuators to power the one of the first and second actuators to raise the load element.

The hydraulic system may further include a pump connected to the control valving, and in the second position the control valving may direct hydraulic fluid from the accumulator to one of the first and second actuators and direct hydraulic fluid from the pump to the other of the first and second actuators to raise the load element.

The hydraulic system may further include a metering valve disposed between the control valving and the accumulator, and when the control valve is in the first position the metering valve may proportionately meter the hydraulic flow to control the rate of lowering the load implement and/or force on the load implement, and when the control valve is in the second position the metering valve may proportionately meter the hydraulic flow to control the rate of raising the load implement and/or force on the load implement.

In the first position the control valving may direct hydraulic fluid from a piston side of the one actuator to the accumulator to charge the accumulator.

In the first position the control valving may direct hydraulic fluid from a piston side of the other of the first and second actuators to rod sides of the first and second actuators to back fill the first and second actuators.

The hydraulic system may further include a proportional valve for controlling the amount of flow of hydraulic fluid from the piston side of the other actuator to the rod sides of the first and second actuators.

In the second position the control valving may direct hydraulic fluid from the accumulator to piston sides of the one or more of the first and second actuators to raise the load implement.

The hydraulic system may further include a pump connected to the control valving, and in the first position the control valving may direct hydraulic fluid from the pump to rod sides of the first and second actuators to back fill the first and second actuators.

The hydraulic system may further include a pump connected to the control valving, and in the second position the control valving may direct hydraulic fluid from the pump to the first and second actuators to power the first and second actuators to raise the load element.

The control valving may combine the hydraulic fluid from the accumulator and the pump and direct the combined hydraulic fluid to the first and second actuators to power the first and second actuators to raise the load element.

The hydraulic system may further include a second proportional valve configured to equalize pressure between the accumulator and the pump.

The load implement and control valving may form part of a boom circuit, and the hydraulic system may further include a swing circuit and a valve, and the valve may be configured to selectively share flow from the boom circuit to the swing circuit.

According to another aspect of the invention, a hydraulic system for recovering potential energy of a load implement of a mobile construction vehicle, includes an actuator configured to be coupled to the load implement for controlling raising and lowering of the load element; a hydraulic pressure transformer configured to transform a relatively lower-pressure/higher-flow hydraulic fluid received from the actuator to a relatively higher-pressure/lower-flow hydraulic fluid and to exhaust the higher-pressure/lower-flow hydraulic fluid to an accumulator to charge the accumulator; and control valving that is operable between a first position at which, during a lowering of the load implement, the control valving directs hydraulic fluid from the actuator to the hydraulic pressure transformer to charge the accumulator, and a second position at which the control valving directs hydraulic fluid from the accumulator to the actuator to power the actuator to raise the load element.

Embodiments of the invention may include one or more of the following additional features separately or in combination.

The hydraulic pressure transformer may include a reciprocating linear actuator that has a relatively larger area chamber that receives the higher-pressure/lower-flow hydraulic fluid from the actuator and a relatively smaller area chamber from which the relatively higher-pressure/lower-flow hydraulic fluid is exhausted to the accumulator.

The hydraulic pressure transformer may include a rotary pressure transformer that has a first pump motor driven by the relatively lower-pressure/higher-flow hydraulic fluid received from the actuator and a second pump motor driven by the first pump motor that exhausts the relatively higher-pressure/lower-flow hydraulic fluid to the accumulator.

The first pump motor may be a bidirectional hydraulic pump motor and the second pump motor may be a variable hydraulic pump motor.

The hydraulic system may further include a prime mover pump connected to the control valving, and in the second position the control valving may direct hydraulic fluid from the prime mover pump to the first pump motor to drive the first pump motor and, in addition, the second pump motor, which is powered by the accumulator, may drive the first pump motor thereby assisting the prime mover pump in driving the first pump motor, and the first pump motor may supply hydraulic fluid to the actuator to raise the load element.

The hydraulic system may further include a prime mover pump connected to the control valving, and a flow passage that combines the hydraulic fluid from the accumulator and the prime mover pump and directs the combined hydraulic fluid to the actuator to power the actuator to raise the load element.

The hydraulic system may further include a prime mover pump connected to the control valving, and in the first position the control valving may direct hydraulic fluid from the prime mover pump to a rod side of the actuator to back fill the actuator.

The load implement and control valving may form part of a boom circuit, and the hydraulic system may further include a swing circuit and a valve, and the valve may be configured to selectively share flow from the boom circuit to the swing circuit.

According to another aspect of the invention, a hydraulic system for a mobile construction vehicle includes a variable displacement track motor configured to be coupled to a track of the mobile construction vehicle to drive the track; an accumulator for storing pressurized hydraulic fluid for use as a power supply to a non-track load implement; a pump dedicated to the track motor; and control valving that is operable between a first position at which the control valving directs hydraulic fluid from the dedicated pump to the variable displacement track motor to drive the variable displacement track motor, and a second position at which the control valving directs hydraulic fluid from the dedicated pump to the accumulator.

Embodiments of the invention may include one or more of the following additional features separately or in combination.

The control valving may include a proportional valve that diverts flow from the track motor to the accumulator in a proportional manner.

The control valving may be configured such that when the control valving is not operating in the first position to direct hydraulic fluid to the track motor the control valving is operating in the second position to direct hydraulic fluid to the accumulator.

The non-track load implement may include a swing motor for driving a swing of the mobile construction vehicle, and the accumulator may be configured to provide the stored pressurized hydraulic fluid to the swing motor to drive the swing motor.

The non-track load implement may include a swing motor for driving a swing of the mobile construction vehicle, and in the second position the control valving may direct hydraulic fluid from the pump to the swing motor to drive the swing motor.

According to another aspect of the invention, there is provided a hydraulic system for storing pressurized hydraulic fluid from a pump of a mobile construction vehicle and using the stored hydraulic fluid to power a track motor of the mobile construction vehicle, the hydraulic system including an accumulator configured to be coupled to the pump to receive and store the pressurized hydraulic fluid from the pump; and control valving that is operable between a first position at which the control valving directs hydraulic fluid from the pump to the accumulator to charge the accumulator, and a second position at which the control valving directs hydraulic fluid from the accumulator to the track motor to power the track motor.

Embodiments of the invention may include one or more of the following additional features separately or in combination.

The hydraulic system may further include the track motor, and the track motor may be a bidirectional overcenter track motor.

The accumulator may be stored within the track.

The control valving may include a proportional valve between the accumulator and the track motor that is configured, when the accumulator is pressurized with hydraulic fluid, to open to allow the accumulator to provide the pressurized hydraulic fluid to the track motor to drive the track motor.

The control valving may include a directional valve that, when the control valving is in the second position, the directional valve directs hydraulic fluid from the pump to the track motor to assist the accumulator in driving the track motor.

When the accumulator is depleted of pressurized hydraulic fluid the directional valve may continue to direct hydraulic fluid from the pump to the track motor to drive the track motor without the accumulator.

According to another aspect of the invention, a hydraulic system includes a first actuator system comprising a first actuator, a first plurality of hydraulic logic elements, and a first proportional valve; a second actuator system comprising a second actuator, a second plurality of hydraulic logic elements, and a second proportional valve; a pump selectively fluidly connectable to the first actuator system through the first proportional valve and selectively fluidly connectable to the second actuator system through the second proportional valve; wherein the first plurality of logic elements control the directionality of a hydraulic fluid between the pump and the first actuator; and wherein the second plurality of logic elements control the directionality of the hydraulic fluid between the pump and the second actuator.

BRIEF DESCRIPTION OF THE DRAWINGS

Embodiments of this invention will now be described in further detail with reference to the accompanying drawings, in which.

DETAILED DESCRIPTION

Figure 1:
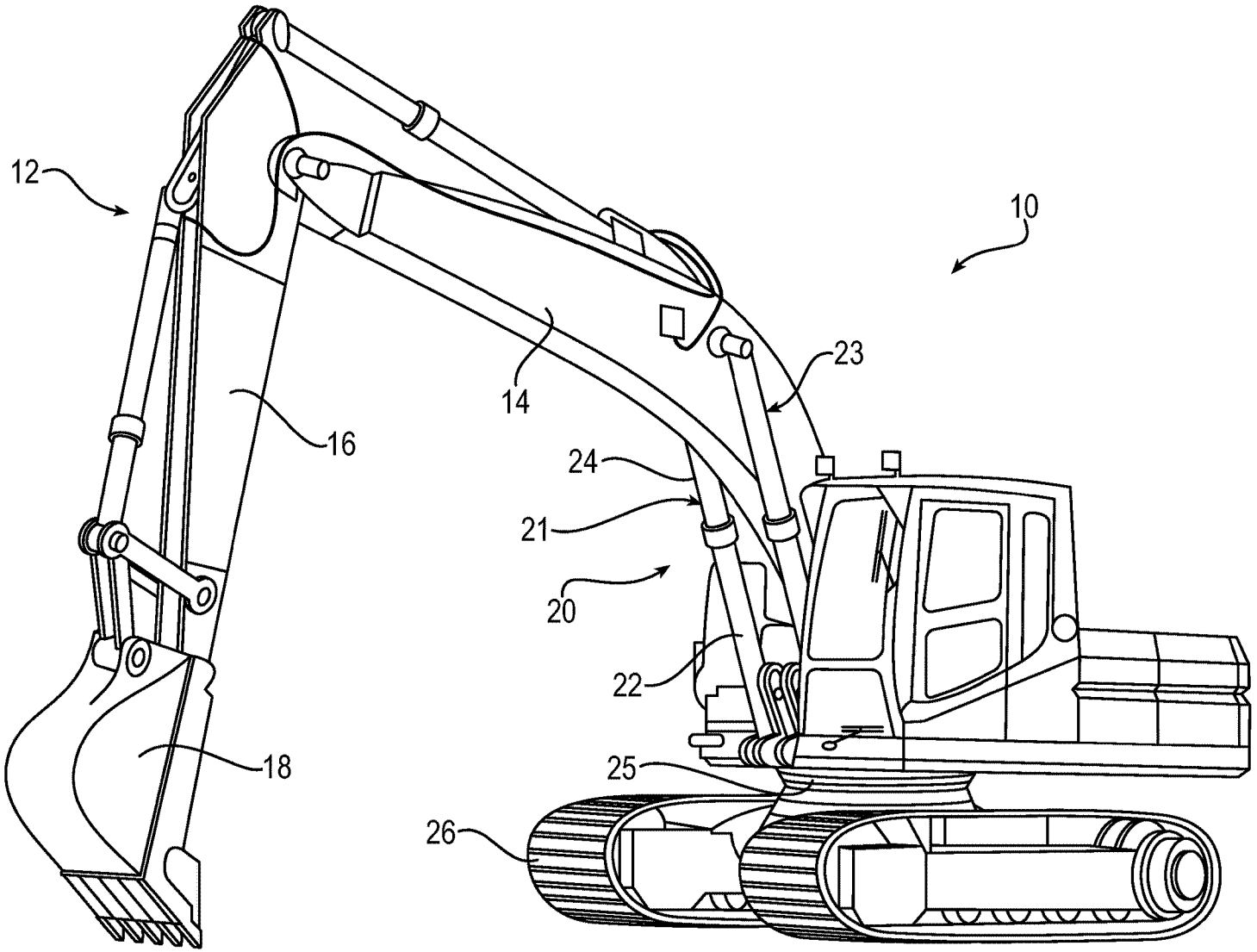
FIG. 1 is a perspective view of a work vehicle of the type used with the present invention.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein, are contemplated as would normally occur to one skilled in the art to which the invention relates.

This invention relates generally to a hydraulic system that provides energy recovery for a machine such as shown in FIG. 1. Although not limited to such, the illustrated machine 10 is an excavator that includes a work implement 12 that may include a boom 14, a stick 16, and a bucket 18. Operations performed by the implement 12 may include, for example, lifting, lowering, and otherwise moving a load (not shown). While the hydraulic system and method is illustrated and described in connection with an excavator, the system and method disclosed herein has universal applicability in various other types of machines as well. The term "machine" may refer to any machine with a hydraulically powered work implement that performs some type of operation associated with an industry such as mining, construction, farming, transportation, or any other industry known in the art. For example, the machine 10 may be an earth-moving machine, such as a wheel loader, excavator, dump truck, backhoe, motor grader, material handler or the like. The implement 12 may be moved to perform its various functions by one or more hydraulic actuators 20 that may be connected between the machine frame and the moving parts of the implement. In the illustrated embodiment, two hydraulic actuators 20 (the first actuator designated 21 and the second actuator designated 23) are provided with each being configured as a double acting hydraulic cylinder with a housing 22 and a piston 24. A swing drive 25 rotates the machine frame relative to the undercarriage, which is equipped with wheels or tracks 26 to move the excavator.

Figure 2:
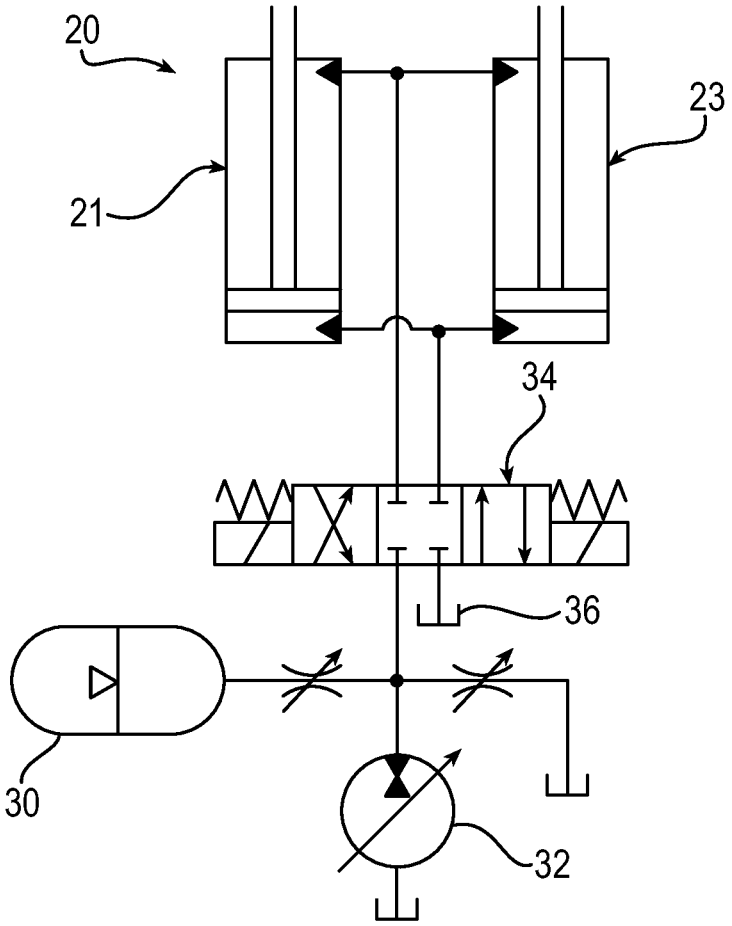
FIG. 2 is a schematic of a boom potential energy recovery system.

FIG. 2 illustrates a configuration of energy recovery where the gravitational potential energy of a mass is recovered. During operation the boom will be extended to complete useful work. When the mass is lowered, flow will be generated on the piston side of the cylinder 20 and can be recovered to some sort of device such as an accumulator 30 or motor 32. In the typical situation the fluid is exhausted from the piston side through a directional control valve 34 to a tank 36 and all of the energy is dissipated through the directional control valve 34. In the typical baseline situation the directional control valve is used to create a specific orifice size to create a controlled amount of metering to result in a controlled descent. However, in FIG. 2 either an accumulator 30, a motor 32, or a combination of these two may be used to create the required back pressure for the controlled descent of the boom cylinder 20.

The basic control strategy for recovering energy and generating the required back pressure will differ between the accumulator 30 and the pump 32. When using the accumulator 30 to control the pressure of the piston side on the boom cylinder 20, a proportional valve may be used to generate a pressure drop between the pressure in the accumulator and pressure desired in the piston chamber of the boom cylinder 20. The metering orifice size may be based on the desired or actual speed of descent of the cylinder as well as for example the current pressure in the accumulator and the desired pressure in the piston chamber of the cylinder which is a function of the mass of the cylinder as well as the pressure on the rod side. When using the pump 32 for energy recovery the speed may be controlled by the amount of fluid consumed by the pump. The amount of fluid consumed by the pump can be altered by either changing the speed of the pump (the engine in this configuration) or adjusting the displacement of the pump. Adjusting the displacement of the pump can be accomplished via a variable displacement pump and adjusting the speed of the pump could be accomplished via some system that decouples the speed of the pump from the prime mover such as an EHA (Electro-Hydrostatic Actuator) system.

Figure 3:
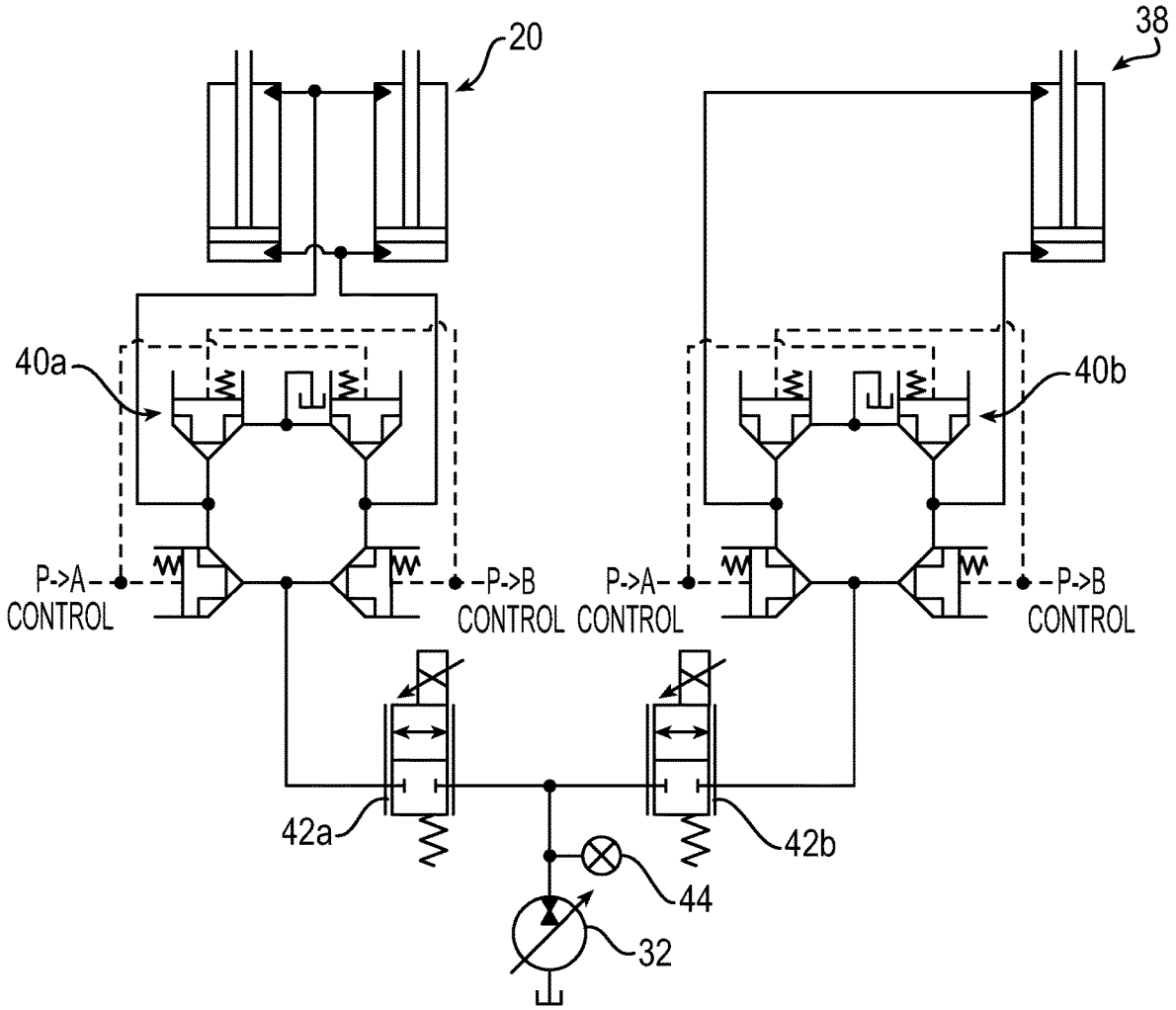
FIG. 3 is a schematic of a distributed control on an excavator with energy recovery.

FIG. 3 illustrates a configuration where multiple actuators can be connected to the same pressure source for both powering and recovery. In FIG. 3, two linear actuators are illustrated 20, 38, but one of those actuators could also be a motor such as one for the swing drive 25. A series of logic elements 40*a*, 40*b* may be used to control the directionality of the fluid from the pump 32 to the work ports to minimize metering losses. To ensure proper distribution of the flow between the actuators 20, 38, proportional valves 42*a*, 42*b* may be used to create the proper pressure drops. Position or speed sensors (not shown) on the actuators 20, 38 which can be used as a measurement of flow, together with the pressure sensor 44 at the pump 32 and a detailed understanding of the flow characteristics of the proportional valves 42*a*, 42*b*, the pressures and flows throughout the circuit can then be known. These control inputs will be sufficient to control the speed of each actuator 20, 38. This system offers an advantage over a typical system as minimal amount of metering can be applied to flow directed towards the higher pressure actuator and this will decrease the amount of metering required to other functions as well as the overall pressure.

The system developed in FIG. 3 is particularly suited to powering a function, but is not particularly suited to recovering energy, as only the pump 32 is available to absorb the flow. In an alternative embodiment, an accumulator may be provided that is used to recover energy as described above with the description of FIG. 2. To the desired speeds of the cylinders the proportional valves will have to meter the flow from the cylinder back to the pump or accumulator to ensure the proper flow rate from each is maintained.

The proportional valves 40*a*, 40*b* illustrated in FIG. 3 can be controlled to obtain the desired flow to each actuator 20, 38. The proportional valves 42*a*, 42*b* should be large enough to handle the flow and to react to sudden changes in pressure. In addition, using an electronically controlled proportional valve may result in sluggishness on the actual machine due to delays in response from the valve and sensors.

Figure 4:
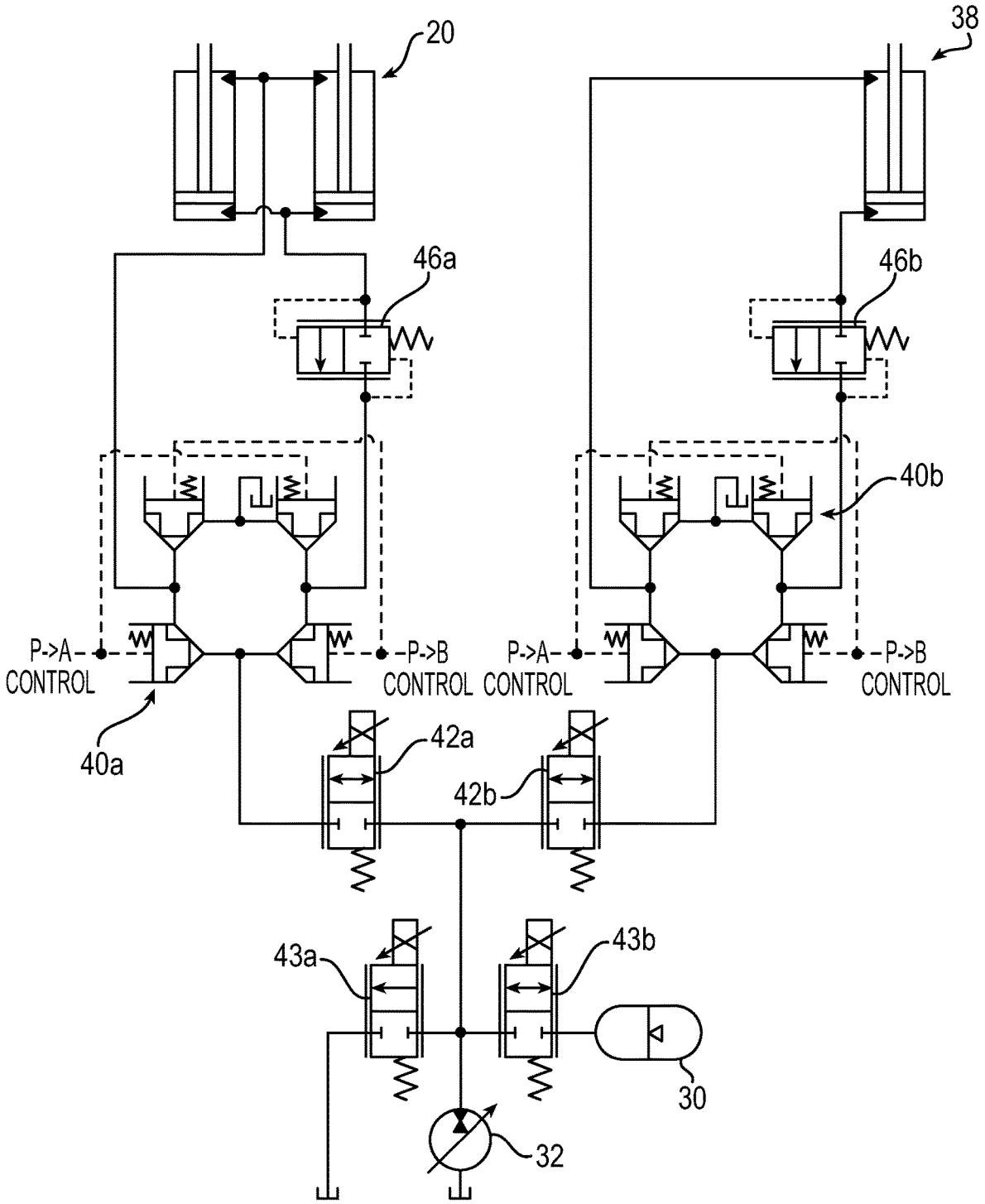
FIG. 4 is a schematic of a potential energy recovery system having back pressure compensators.

FIG. 4 illustrates a configuration where compensators 46*a*, 46*b* are used to control the back pressure from the cylinders 20, 38 and ensure the pressure from each actuator is the same when it reaches the main pressure line where the pump 32 and accumulator 30 are located for energy recovery purposes. The pressure compensators 46*a*, 46*b* illustrated in FIG. 4 are controlled passively by the upstream flow coming from the actuators 20, 38 and the downstream flow headed towards either a directional control valve or the pump 32 and accumulator 30. The upstream pressure causes the compensator 46*a*, 46*b* to open and the downstream pressure causes the compensator to close along with a spring; this arrangement of actuation forces will cause the compensator to maintain a pressure drop and ensure a consistent meter out pressure from all of the functions. Proportional valve 43*a* is selectively connectable to the tank and proportional valve 43*b* is selectively connectable to the accumulator 30. When combined with a four position proportional spool valve (not shown) this will allow a controlled descent of the cylinders.

Figure 5:
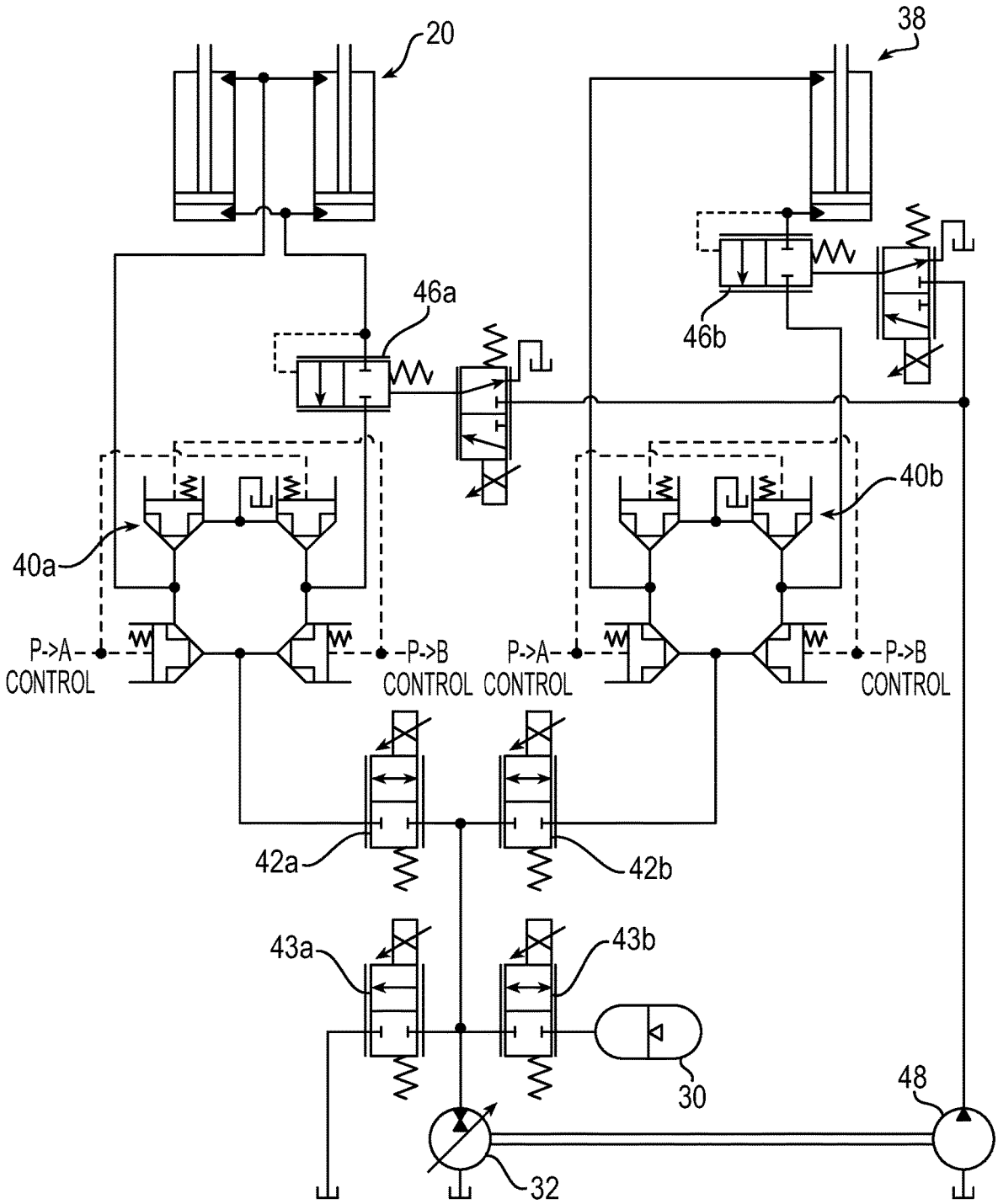
FIG. 5 is a schematic of a potential energy recovery system having alternative pressure compensators.

FIG. 5 illustrates an alternative arrangement where the upstream pressure attempts to the open pressure compensators 46*a*, 46*b* but a controlled pressure is used in place of the downstream flow to close the compensator. The externally controlled pressure from pump 48 will allow each compensator 46*a*, 46*b* to have a different pressure from each function to the main pressure line, but also allow each function to travel at different rates. A pressure reducing valve could be used to generate the controlled pressure, but other means may be possible. In some situations, it may be desirable to be able to regulate the pressure in both directions.

Figure 6A:
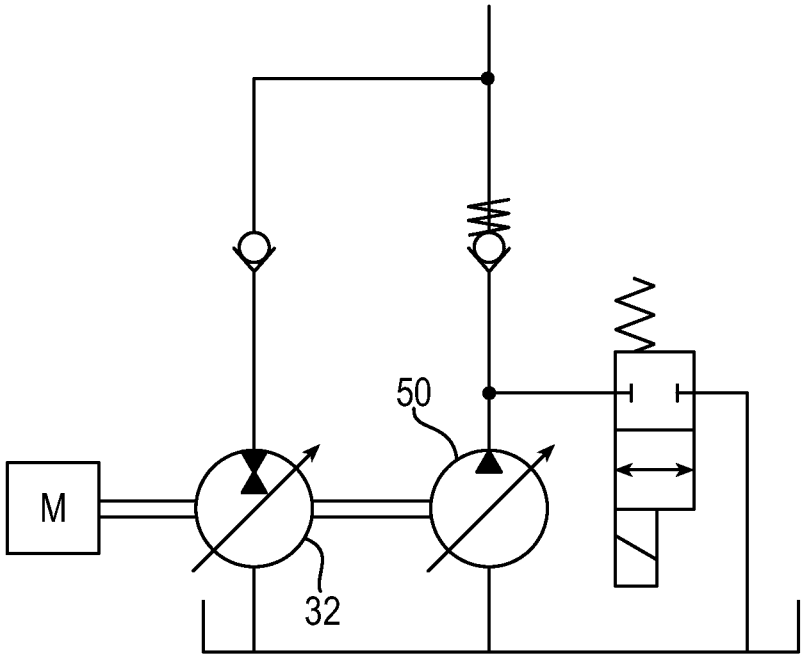
FIGS. 6*a* and 6*b* are schematics of different pump configuration for extension to a swing circuit to improve energy recovery efficiency.
Figure 6B:
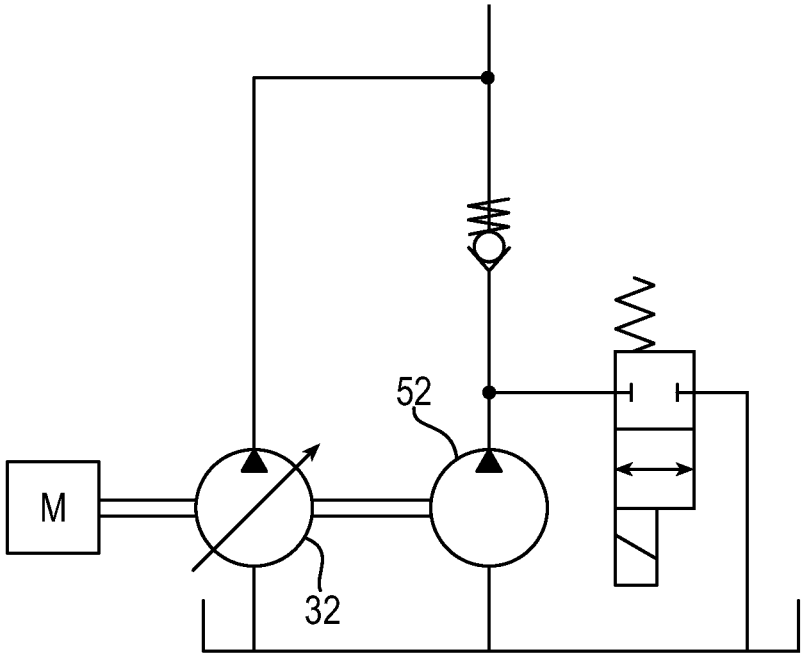

The typical speed for the swing function is less than half of the maximum speed which means that the typical flow is less than half of possible maximum flow. The speed of the swing drive 25 may be directly coupled with the amount of high pressure flow when powering the function as well as the amount of high pressure flow exiting the swing drive 25 when braking. Therefore, if a pump is sized to be able to provide the maximum amount of flow required it will be typically oversized to provide the average amount of flow required, which may potentially lead to inefficient operation due to the properties of variable displacement pumps (which is a typical method for providing flow to the swing motor). However, utilizing more than one pump such as illustrated in FIG. 6*a* may improve the efficiency of the swing drive 25 as during low speed for example, and therefore low flow operations. Only one pump may be utilized unloading the second pump 50, and therefore a high displacement and efficiency can be obtained. This stems from the fact that the leakage of a pump is typically directly related to the pressure the pump is operating and therefore at lower displacements the leakage contributes a higher percentage to the overall pumps theoretical output. This will also assist in improving efficiency when recovering high pressure flow as well. FIG. 6*a* illustrates a configuration where two variable displacement pumps 32, 50 are used and FIG. 6*b* illustrates a configuration where one variable displacement pump 32 and one fixed displacement pump 52 are used. Other pump combinations are possible and the selection of these combinations depends on the desired efficiency, controllability, cost, etc. Control complexities may be required to ensure smooth transitions between one pump and two pumps, but utilizing two pumps offers other possibilities for combining other functions such as boom recovery and track. While using this on the swing drive 25 may make the most sense efficiency wise because of the operating modes, it can also be applied to other functions, multi-functions, using over center units for recovery, and even with an accumulator in parallel.

Figure 7:
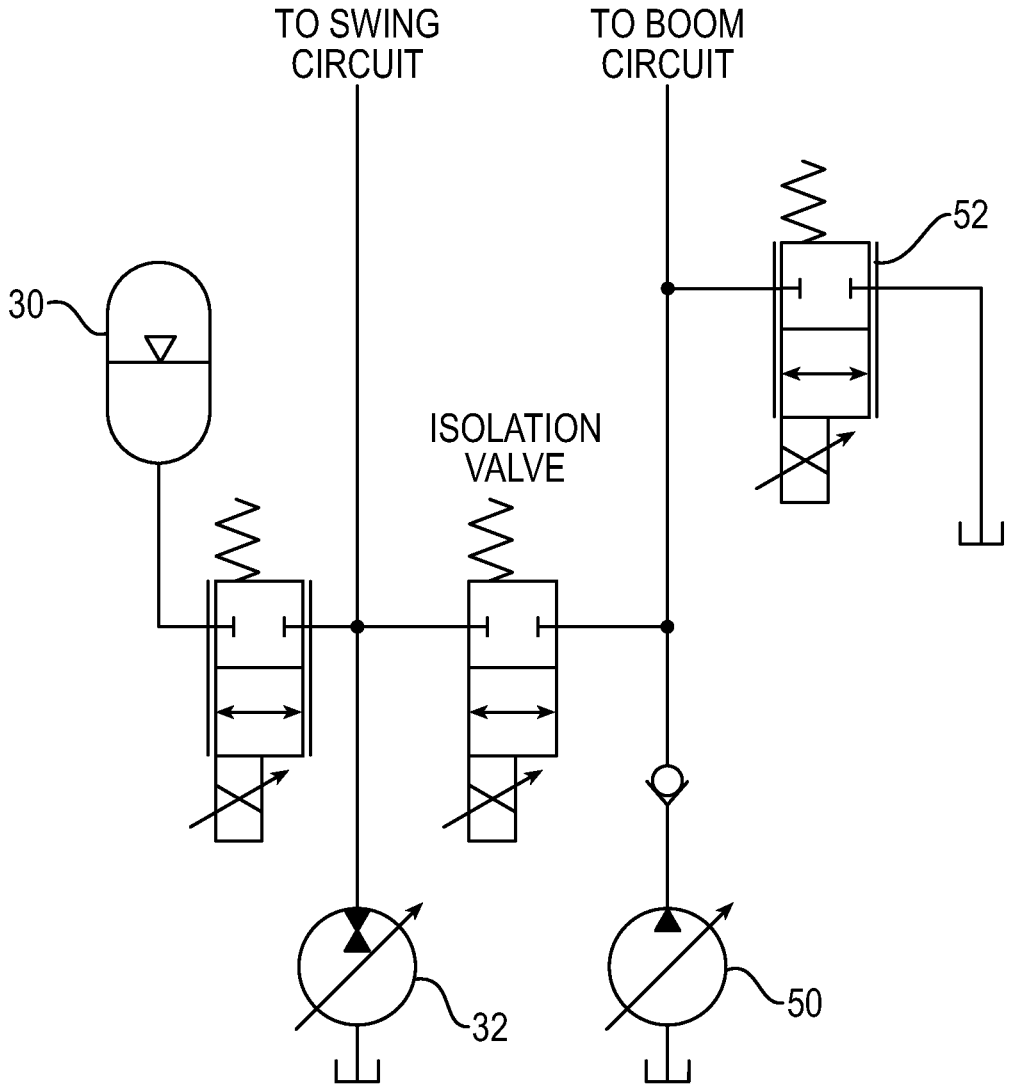
FIG. 7 is a schematic of a boom and swing potential energy recovery system with different pump configurations.

FIG. 7 illustrates a system where two variable displacement pumps 32, 50 are installed for the swing function, but is also connected in such a manner that the boom potential energy can be recovered. The energy from the boom function or the swing function can be stored in the accumulator 30 or recovered to the pump-motor 32 and sent back to the engine shaft to be utilized immediately. The back pressure on the boom function can be controlled either by a proportional valve 52 or by a combination of a proportional valve and the pump-motor. One problem that may arise is the difference in pressure between the braking of the swing drive and the boom down (descent) pressure of the boom; this difference in pressure may result in inefficient recovery and poor control and performance of the swing and boom function. Embodiments described later herein discuss how to correct the difference in pressures between the various functions.

To improve fuel efficiency and reduce cost, the engine size may be reduced by load leveling or peak shaving. This in turn means that an engine can be downsized as less peak power is required; an energy storage device can provide bursts of power when required to meet the power demand and performance requirements. The techniques discussed so far and that will be de discussed hereafter load level and shave the peaks from the boom, arm, bucket, and swing functions on the excavator.

On a baseline excavator the track function is controlled by variable displacement motors and the fluid is supplied from the variable displacement pumps. On a typical excavator the track motors are capable of varying their displacements but only to a limited number of discrete positions; typically two positions. The track function is connected to supply flows at higher pressures so combinations of speeds and torques can be obtained for moving at the required speeds or climbing slopes. However, newer solutions are moving to an individualized approach for each function and therefore there may be a dedicated pump for the track function; and often these pumps 54, 56 are directly connected to the engine M and may be constantly spinning. The track function on an excavator is typically used sparingly and therefore pumps installed just for the track function may be churning constantly and wasting energy. There are a number of ways to minimize this churning loss such as clutching the pumps out when not required or combining the track pumps with other functions.

Figure 8:
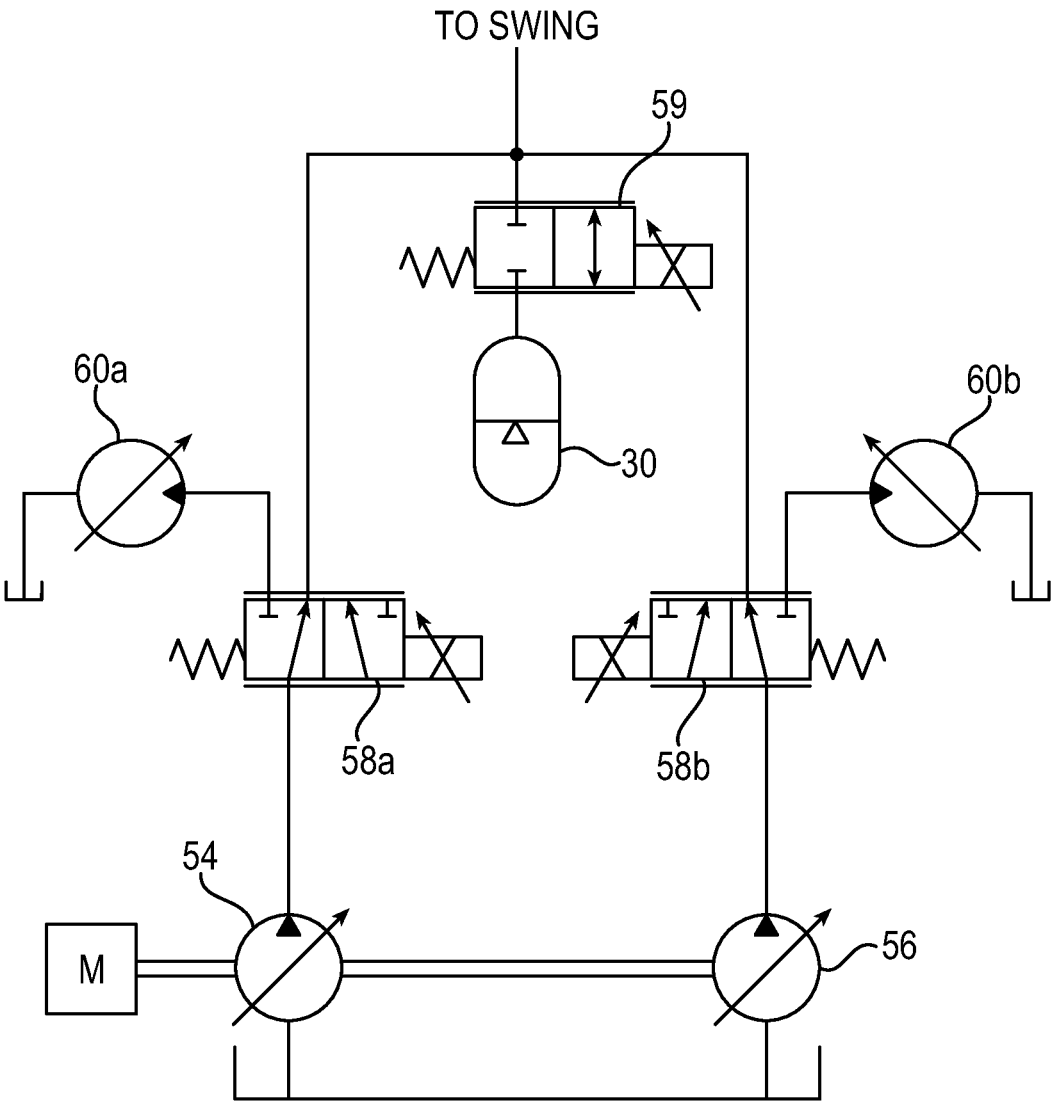
FIG. 8 is a schematic of a more efficient implementation of track functions in a hybrid swing/boom system.

FIG. 8 shows a hydraulic system that more efficiently implements the track function. The FIG. 8 system includes the engine M, the two variable displacement pumps 54, 56, two valves 58*a*, 58*b*, two track motors 60*a*, 60*b*, the swing function, the swing accumulator 30 and a proportional valve 59 between the accumulator 30 and the swing. The pumps 54, 56 are dedicated to power the track motors 60*a*, 60*b* while a swing pump is dedicated to power the swing motor, although as described in greater detail below, in an alternate embodiment the pumps 54, 56 can power both the track motors 60*a*, 60*b* and the swing motor, and/or power other functions such as the boom, among others. Further, as noted herein the pumps 54, 56 can also be made available for boom down (descent) recovery. The energy recovery can be accomplished via either recovery to the accumulator 30 or recovery directly to the engine shaft. As the pumps 54, 56 can be used for three different functions the use of the pumps 54, 56 for one of those functions is reduced and therefore the perceived waste of energy is reduced. The variable nature of both the pumps 54, 56 and the motors 60*a*, 60*b* can allow the excavator 10 to be more able to provide the speed and torque required.

The valves 58*a*, 58*b* of the system illustrated in FIG. 8 are proportional valves 58*a*, 58*b*, although the system need not be limited as such. It will be appreciated that the valves 58*a*, 58*b* can alternatively be digital valves; that is, the valves 58*a*, 58*b* can be capable of diverting flow from the variable displacement pumps 54, 56 in either a proportional manner or a digital manner. The track motors 60*a*, 60*b* of the FIG. 8 system are fully variable displacement motors. The variable displacement nature of the motors 60*a*, 60*b* enables the motors to capture more of the operating range from which the efficiency and the torque requirement on the tracks can be increased. The track system may function similar to a hydrostatic mechanism.

Referring to FIG. 8, the engine M drives the variable displacement pumps 54, 56, which draw hydraulic fluid from the tank. Referring to the right box flow pattern of the proportional valve 58*a* and the left box flow pattern of the proportional valve 58*b*, hydraulic fluid from the pumps 54, 56 can be routed to the respective variable displacement track motors 60*a*, 60*b* to power the track motors 60*a*, 60*b*. With the proportional valve 59 at the top of FIG. 8 open, swing braking can be used to charge the swing accumulator 30. Referring to the left box flow pattern of the proportional valve 58*a* and the right box flow pattern of the proportional valve 58*b*, hydraulic fluid from the pumps 54, 56 can be diverted from the track motors 60*a*, 60*b* to the swing circuit. The pumps 54, 56 are therefore no longer driving the track motors 60*a*, 60*b*. With the proportional valve 59 open, and with the connection to the swing movement disabled, the hydraulic fluid from the pumps 54, 56 can be routed to the swing accumulator 30 to charge the swing accumulator 30. This can be done for example to charge the accumulator 30 before, after, or as the swing braking charges the accumulator 30. As will be appreciated, the swing accumulator 30 can be charged by the pumps 54, 56 whenever there is available engine power. As will also be appreciated, the pumps 54, 56 need not be idle when not driving the track motors 60*a*, 60*b*, and can instead be used to charge the accumulator 30.

In the FIG. 8 hydraulic system, the swing function has its own pump to drive the swing motor, it being part of a pump controlled actuation architecture that dedicates pumps to respective functions. In an alternate embodiment, the dedicated swing pump can be omitted and the swing motor can instead be powered by the track function pumps 54, 56. It will be appreciated, of course, that the pumps 54, 56 can also be prime movers that power still other functions such as the boom, among others. With respect to FIG. 8, with the proportional valves 58*a*, 58*b* diverting hydraulic flow to the swing function, and with the proportional valve 59 choked off, the variable displacement pumps 54, 56 can be used to power the swing motor. As will be appreciated, this can be an efficient use of the pumps 54, 56 since it is rare that the swing function is used simultaneously as the track function is used. And in the rare event that the swing function is necessary or desired when the pumps 54, 56 are powering the tracks, with the proportional valve 59 open, the swing accumulator 30 can provide power to the swing motor, at least for example to make minor adjustments in the swing movement. Of course, this embodiment also enables the pumps 54, 56 to power both the track motors 60*a*, 60*b* and the swing motor at the same time, for example, where the proportional valve 59 at the top of FIG. 8 is choked off and the proportional valves 58*a*, 58*b* direct flow to both the track function and the swing function. To lower the power demand on the pumps 54, 56 and consequently the engine size requirements as discussed above, the accumulator 30 can assist the pumps 54, 56. With the proportional valve 59 open, the pumps 54, 56 and the accumulator 30 can power the swing function. In one mode, the accumulator 30 can power the swing motor, i.e. without the pumps 54, 56. In an intermediate mode, as the accumulator 30 starts to deplete then both the accumulator 30 and the pumps 54, 56 (or one of the pumps 54, 56 if desired) can power the swing motor, where the proportional valve 59 equalizes the pressure between the accumulator 30 and the pumps 54, 56. As the accumulator 30 continues to deplete in pressure, the pumps 54, 56 can gradually provide a greater amount of power. Where the accumulator 30 is finally depleted, then in a third operating mode the proportional valve 59 can be choked off and the pumps 54, 56 take over in the swing movement, in which case there is more of a flow controlled actuation than a pressure controlled actuation.

In another embodiment, the hydraulic system does not necessarily have to be tied to a pump controlled actuation architecture, and instead a conventional prime mover system can be used, for example, where two prime mover pumps power all of the functions. In such a system, the pumps could provide hydraulic fluid through the track spool of conventional excavator control valves (instead of diverting valves)

that, in turn, route the hydraulic fluid to the variable displacement track motors 60*a*, 60*b* to drive the tracks. The variable displacement motors 60*a*, 60*b* would allow more efficient use of the hydraulic flow from the pumps even in such a conventional prime mover system.

Figure 9:
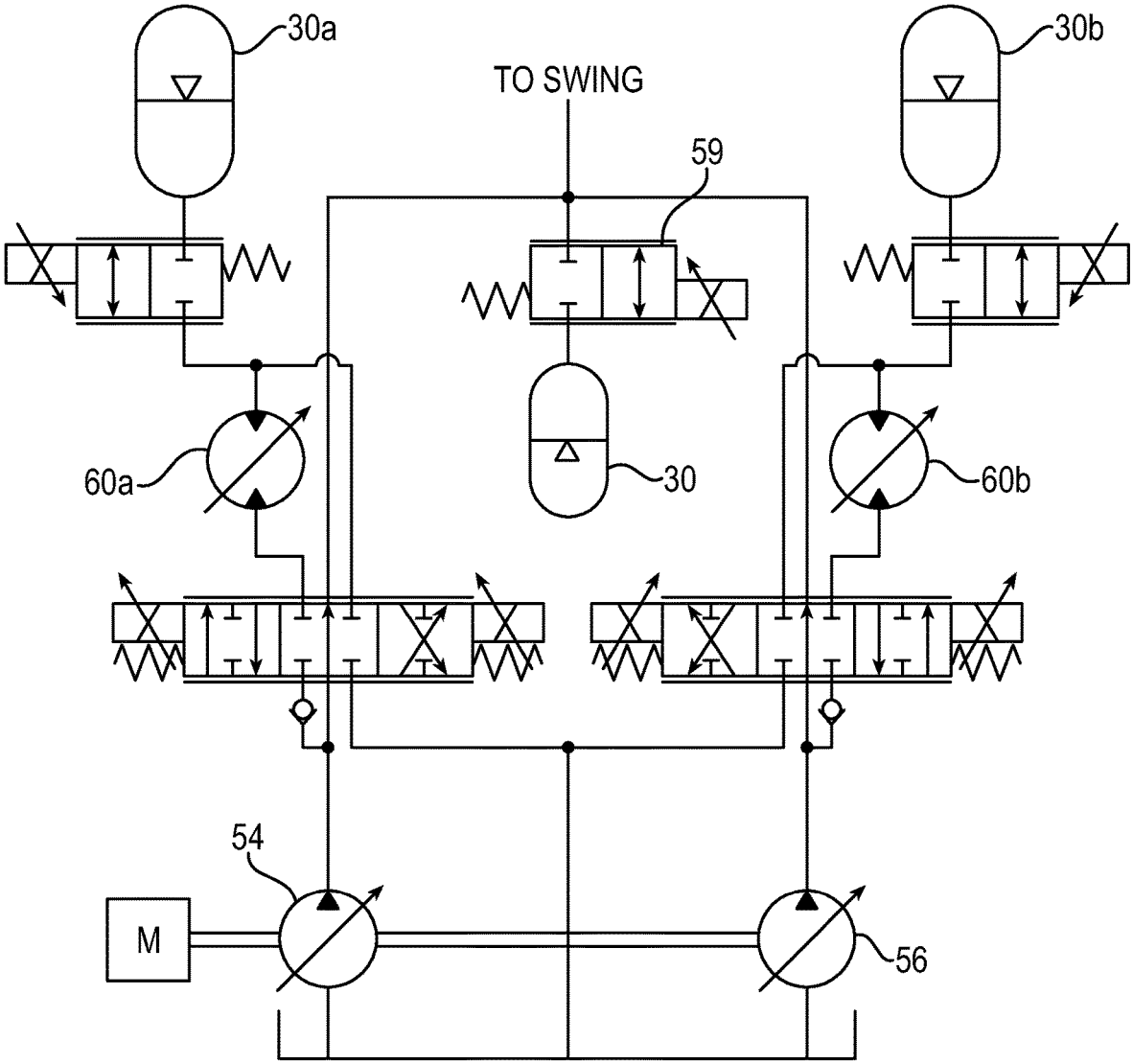
FIG. 9 is a schematic of an alternate configuration of track implementation using accumulators for energy storage and re-use on demand.

FIG. 9 shows a hydraulic system similar to that of FIG. 8, except further including track accumulators 30*a*, 30*b* for energy storage and re-use on demand. The components of the FIG. 9 system are in many respects substantially the same as the above-referenced FIG. 8 system, and consequently the same reference numerals are used to denote structures corresponding to similar structures. The foregoing description of the hydraulic system of FIG. 8 is equally applicable to the FIG. 9 hydraulic system, except as may be noted herein. Moreover, it will be appreciated upon reading and understanding the specification that aspects of the FIG. 8 and FIG. 9 hydraulic systems may be substituted for one another or used in conjunction with one another where applicable.

The FIG. 9 hydraulic system includes the engine M, the two variable displacement pumps 54, 56, two check valves, two excavator control valves, two bidirectional over-center track motors 60*a*, 60*b*, the two track accumulators 30*a*, 30*b*, the proportional valves between the track accumulators 30*a*, 30*b* and the track motors 60*a*, 60, the swing function, the swing accumulator 30, and the proportional valve 59 between the accumulator 30 and the swing function. The track accumulators 30*a*, 30*b* and their respective proportional valves are disposed inside the tracks themselves, i.e. in the space within the tracks. As described in greater detail below, the accumulators 30*a*, 30*b* can provide an extra power source for the track motors 60*a*, 60*b*. The accumulators 30*a*, 30*b* can be charged for example when the prime mover pumps 54, 56 are not being otherwise utilized, and this stored energy in the accumulators 30*a*, 30*b* can allow for less power demand from the track functions for a period of time until the accumulators 30*a*, 30*b* are depleted. With an appropriate duty cycle, the FIG. 9 system would enable downsizing of the engine.

Referring to the circuit of FIG. 9, and more particularly to the center box flow pattern of the excavator control valves, hydraulic fluid from the pumps 54, 56 is routed to the swing circuit. As with the FIG. 8 system, the pumps 54, 56 can charge the swing accumulator 30, power a swing motor where a swing pump is omitted, among other functions referred to with respect to the FIG. 8 embodiment. Referring to the left box flow pattern of the left excavator control valve and the right box flow pattern of the right excavator control valve, hydraulic fluid from the pumps 54, 56 can be diverted from the swing function to the track motors 60*a*, 60*b* via the respective check valves to power the respective track motors 60*a*, 60*b*, for example in a forward direction. With the proportional valves between the track motors 60*a*, 60*b* and track accumulators 30*a*, 30*b* closed, hydraulic fluid downstream of the track motors 60*a*, 60*b* is routed to the tank. Referring to the right box flow pattern of the left excavator control valve and the left box flow pattern of the right excavator control valve, hydraulic fluid from the pumps 54, 56 can be diverted from the swing function to the track motors 60*a*, 60*b* via the respective check valves to power the respective track motors 60*a*, 60*b*, for example in a reverse direction. With the proportional valves between the track motors 60*a*, 60*b* and track accumulators 30*a*, 30*b* open, and the track motors 60*a*, 60*b* operated at for example zero percent displacement, the pumps 54, 56 can provide pressurized hydraulic flow to the respective track accumulators 30*a*, 30*b*, to charge the track accumulators 30*a*, 30*b*. The pumps 54, 56 can charge the accumulators 30*a*, 30*b* until the accumulators 54, 56 are charged to a predetermined pressure and/or until a not-shown relief valve opens.

As will be appreciated, the track accumulators 30*a*, 30*b* can be charged any time the tracks are not being used. When the tracks are used, i.e. powered by the track pumps 54, 56, and with the proportional valves between the track motors 60*a*, 60*b* and track accumulators 30*a*, 30*b* open, the charged accumulators 30*a*, 30*b* can serve as a boost system to provide additional power to the pumps 54, 56 to drive the track motors 60*a*, 60*b*, for an amount of time time until the accumulators 30*a*, 30*b* are depleted. The accumulators 30*a*, 30*b* can thus aid the pumps 54, 56 in driving the track function, thus reducing the power demand on the engine and, accordingly, enabling the size of the engine to be reduced if desired. As noted above, with a proper duty cycle the engine size can be downsized with little or no compromise to performance or functionality. A proper duty cycle can consider for example passively charging the accumulators 30*a*, 30*b* at any period of time where there is available engine power. Of course, in instances where the amount of time to deplete the accumulators 30*a*, 30*b* is exceeded, the reduced size engine would provide a decreased amount of movement power to the pumps 54, 56 until the accumulators 30*a*, 30*b* are recharged sufficiently to power-assist the track motors 60*a*, 60*b*, although due to the variable displacement nature of the track motors 60*a*, 60*b* the performance decrease will be less significant than a stock system which utilizes motors that can only be in two different displacement modes.

In the illustrated embodiment, the track motors 60*a*, 60*b* are overcenter motors and, as such, the motors can travel in both directions; that is, the track motors 60*a*, 60*b* enable the vehicle to move forward or backwards. The FIG. 9 system need not be limited as such and other embodiments are contemplated. In an alternative embodiment, for example, a selector valve can be employed to route hydraulic fluid to either side of the motor, as will be appreciated.

The several embodiments herein enable energy recovery and pressure leveling. As discussed before, the braking pressure of the swing and the boom down pressure may be very different. For example, the braking pressure of the swing drive may be approximately 240 bar, while the boom down piston side pressure may vary between 30 bar and 60 bar. However, as will be appreciated the boom down pressure can vary well outside this range. On the acceleration side the swing drive 25 can accelerate around for example 240 bar, in line with the brake pressure, but the pressure required to raise the boom may be related to the load and vary dramatically; and in some cases can be quite high. In terms of flow, the swing drive 25 may exhibit a flow rate of for example approximately 80-100 liters per minute, while the boom function may exhibit flow rates of for example 300 liters per minute. As will be appreciated, in terms of efficiency for hydraulic machines, high flows and low pressures are typically less efficient than low flows and high pressures. The method described herein efficiently increases the pressure of the boom flow and decreases the flow rate to bring it more in line with that of the swing drive 25, as well as works in the "sweet-spot" of hydraulic equipment.

Figure 10:
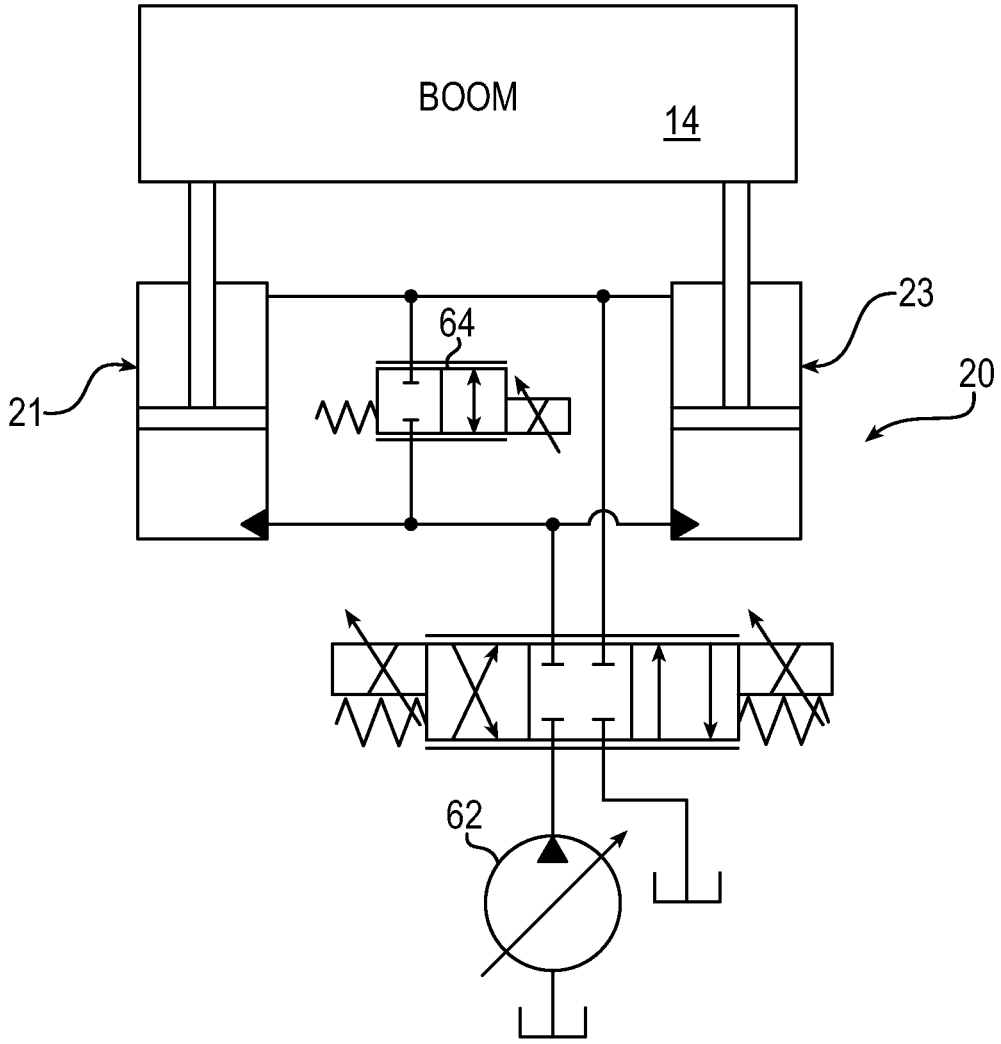
FIG. 10 is a schematic of a boom, on demand proportional regen connection.

FIG. 10 illustrates a system where a proportional valve 64 can selectively connect together the piston side and rod side of a cylinder during either a boom up or boom down operation. The piston side of the boom cylinder 20 may be connected to the proportional valve 64 as shown as well as to a means to recover energy such as the as-shown motor 62 and/or an accumulator and/or a system such as that described in FIG. 6, 7 or 8. Although it is shown as a single spool valve, this can be applied in an independent metering fashion as well with individual valves for each connection. When the proportional valve 64 is fully opened the pressure on the rod side and the piston side will be the same and effectively the rod area on the piston side will be supporting the weight of the cylinder and its load. The weight of the cylinder and its load will cause it to descend. The amount of flow leaving the cylinder will be equal to the speed of the cylinder descending multiplied by the rod area, but at a greatly increased pressure as the effective area supporting the load is greatly reduced. This system is able to increase the pressure and reduce the flow which will allow the hydraulic equipment to more efficiently capture the energy. An added control feature of this system is using the proportional valve 64 to limit the pressure on the rod side of the chamber by restricting the flow through the proportional valve 64. This will decrease the pressure in the rod side of the cylinder as well as decrease the pressure on the piston side of the chamber. No additional flow is required to "back-fill" the rod side of the cylinders as this is accomplished in the natural lowering process. In instances where the boom cylinders 20 are not powered down, to prevent any discontinuity in feel when approaching the ground the "regen" system can be disconnected so the boom 14 can be powered into the ground for digging operations. One method that can be used to accomplish this is to have an optical, proximity, auditory, or some other type sensor to detect the oncoming ground and pre-emptively power the rod side while disabling regen. Another method, which will be described in greater detail below is to use a passive circuit using accumulator pressure as a standby pressure that does not require pump power to have at standby. This "regen style" circuit can provide a two-fold benefit. For example, the amount of flow required when lowering the boom can be reduced or eliminated and this may decrease the amount of installed flow required; i.e. the pump size can be potentially reduced. Secondly, the pressure filling the rod side of the cylinder is typically low, but a high flow is required, which is a poor operating point for a pump; by eliminating this flow requirement less flow will be metered and the pump will not operate as much at an inefficient point.

Figure 11:
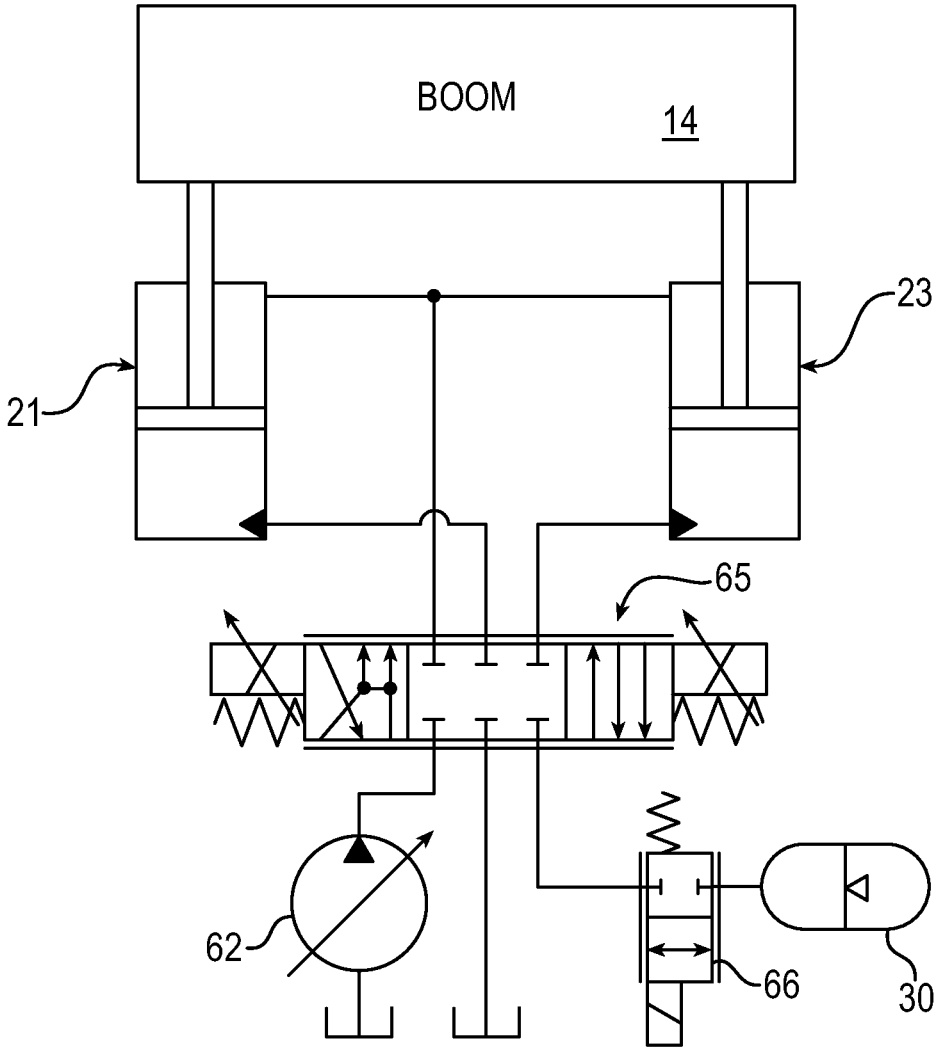
FIG. 11 is a schematic of a boom separated piston connections for single cylinder lowering.

The system in FIG. 11 behaves similarly to the "regen style" circuit in that it is designed to boost the pressure and reduce the flow returning from the boom pistons. This can increase the efficiency of the process if a pump is used for recovery and/or it can shrink the size of the required accumulator 30 if an accumulator method is used. Using a single cylinder 23 to recover halves the effective area, doubling the recovered pressure. A metering valve 66 can be used with the accumulator 30 since the pressures are not separated, and the accumulator pressure may need to match a common braking pressure.

Figure 11A:
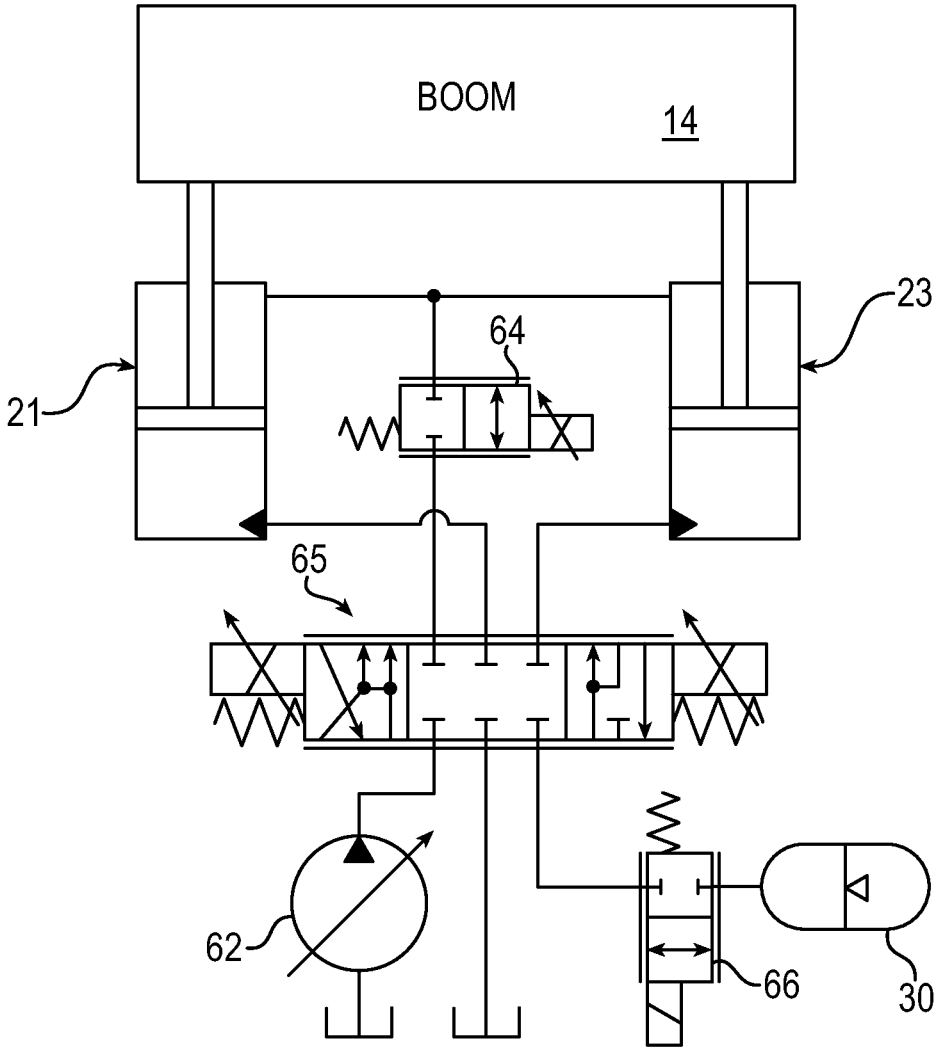
FIG. 11A is a schematic of another boom separated piston connections for single cylinder lowering.

FIG. 11A is a system similar to the FIG. 11 system except the FIG. 11A system includes a proportional valve 64 and a control valve 65 having different flow paths. Referring to the right box flow patterns of the control valve 65, as the boom is lowered hydraulic fluid from the piston side of the actuator 23 is routed to the accumulator 30 and fluid from the piston side of the actuator 21 is routed to the proportional valve 64 and then to the rod sides of the cylinders 21, 23. In the case of zero input energy and all gravity driven, i.e. where it is desired to have all of the boom potential energy recovered, the pump 62 provides no input and the proportional valve 64 is fully open, so that the fluid pressure from the piston side of the left side cylinder 21 powers both of the rod sides of the cylinders 21, 23, and the fluid from the piston side of the right side cylinder 23 is entirely taken up by the accumulator 30. As will be appreciated, the potential energy stored in the accumulator 30 comes from only the piston side of the right side cylinder 23. The system thus employs uneven loading wherein, instead of two cylinders 21, 23 resisting the load from the boom dropping, only the right side cylinder 23 provides such resistance. The right side cylinder 23 has double the amount of force and thus can create double the amount of pressure. In this sense, using the single cylinder 23 instead of two cylinders 21, 23 is a form of hydraulic pressure transformer in that the single cylinder 23 provides half the flow but results in double the pressure.

Of course, there may be cases where it is desirable that the pump 62 provide input energy or a purely gravity driven drop of the boom is not desired, such that it is not possible to recover all of the boom potential energy. Still referring to the right box flow patterns of the control valve 65, if an operator command is to drop the boom faster than what can be provided by gravity then the pump 62 can be used to add flow to aid in the dropping rate. With the proportional valve 64 fully open, the pump 62 provides pump flow through the proportional valve 64 to the rod sides of the cylinders 21, 23 and to the piston side of the left side cylinder 21 to thereby urge the boom to drop faster. This can also facilitate smoother transition for powering into the ground. If the operator command is to power into the ground upon the boom hitting ground, the pump 62 can provide pump flow to the rod sides of the cylinders 21, 23 prior to hitting the ground, so that the boom will have standby power to power into the ground. If the operator command is to lower the dropping rate of the boom, the proportional valve 64 can be choked as desired to effectively create more resistance to the rod side areas, thereby slowing down the rate of fall of the pistons and thus the rate of drop of the boom. With the standby pressure on the pump 62, once the boom hits the ground the proportional valve 64 can be fully opened and digging can be started immediately. Of course, if the operator command is to slow the boom drop rate even further, the pump flow can be reduced accordingly, or to zero, and the proportional valve further choked.

Referring now to the left box flow patterns of the control valve 65, to raise the boom, the pump 62 as well as the stored energy in the accumulator 30 pressure both of the piston sides of the actuators 21, 23. The accumulator 30 adds flow to the flow of the pump 62 at the same pressure. The proportional valve 66 at the accumulator 30 can equalize the pressure between the accumulator 30 and the pump 62. As the accumulator 30 starts to deplete, the pump 62 can provide greater flow. The accumulator 30 can provide flow as it depletes until it meets a certain pressure for example the pressure required to actuate the boom. Once the accumulator 30 reaches such pressure, power can no longer be drawn from the accumulator 30. As such, the proportional valve 66 can be choked off and drive can be provided from the pump 62.

The hydraulic systems of FIGS. 11 and 11A are preferably configured such that their actuators 21, 23 are oriented vertically or generally close to vertical, rather than horizontally. As will be appreciated, such vertical orientation will more effectively gravity-assist the lowering of the boom. Of course, linkages could be provided to convert any horizontal movement to a more generally vertical movement.

Figure 12:
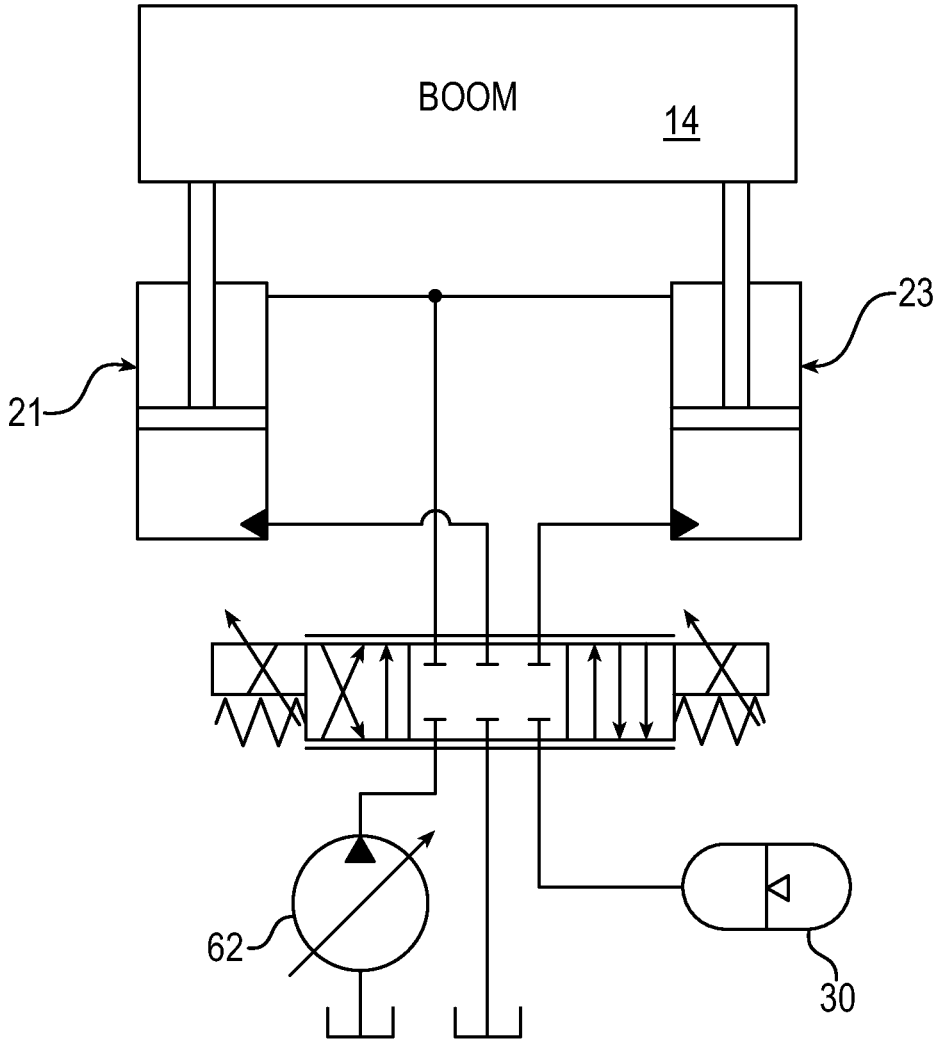
FIG. 12 is a schematic of a boom recovery and reuse system utilizing an accumulator on one cylinder and stock pumps powering the second cylinder.
Figure 13:
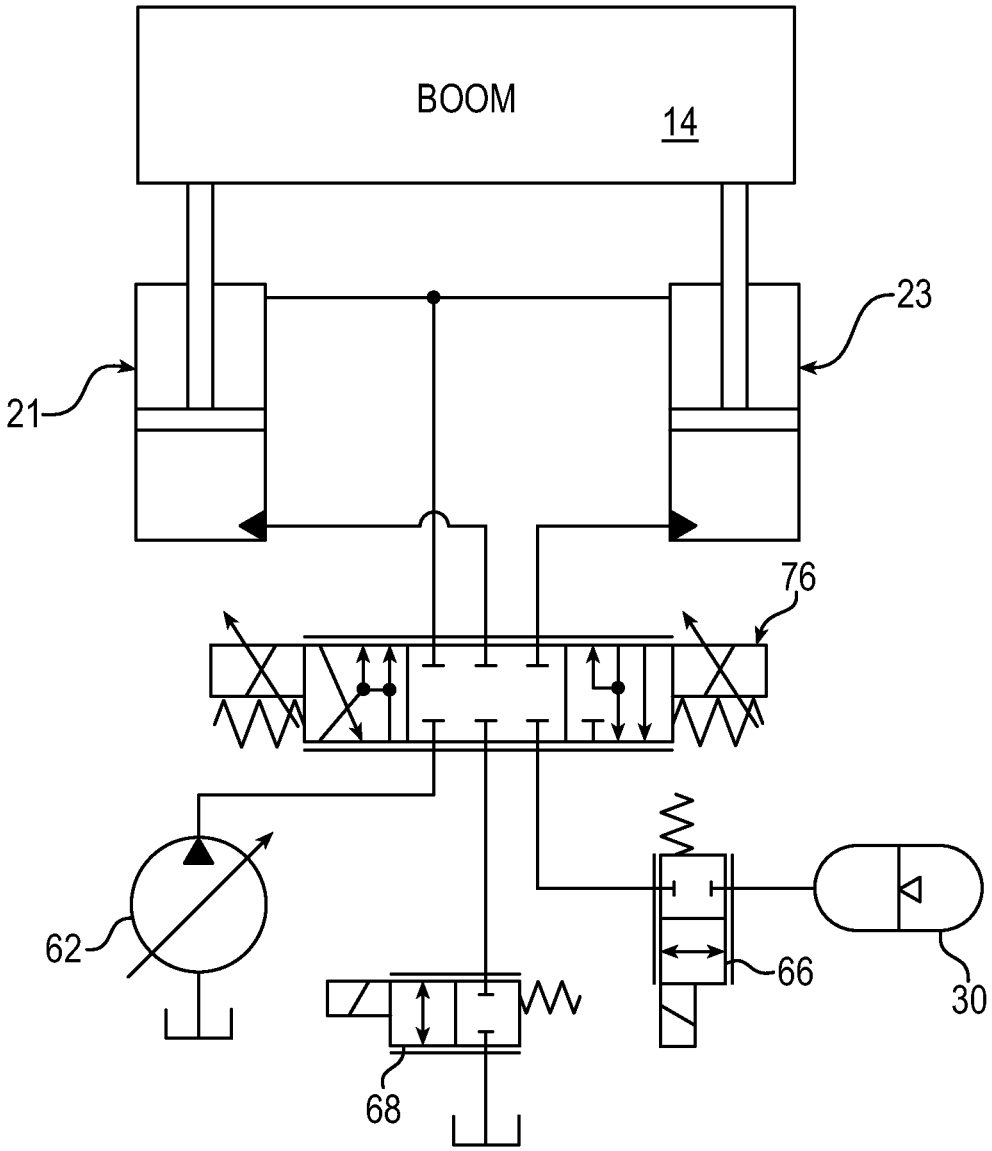
FIG. 13 is a boom separated piston connection for single cylinder lowering with regeneration on the second cylinder.

Similar to FIGS. 11 and 11A where an accumulator is used to recover from only one cylinder 23, FIG. 12 shows powering from the accumulator 30 with only one cylinder as a way to re-use the energy. The second cylinder 23 would be powered by the stock pumps, which can be pump 62 in some embodiments, with the accumulator 30 to supplement, reducing the required input energy. Each cylinder 21, 23 could have a different pressure, easing the valving setup and increasing the efficiency so long as the boom structure 14 is configured to withstand this differential force. This would ease controllability and allow use of the captured energy in an efficient manner. Initially as the pressure in the accumulator 30 is quite high, the amount of force generated by the other cylinder 21 would be relatively low. However, as the accumulator 30 assists in raising the boom 14, the pressure would begin to decrease and therefore the stock pumps would need to provide additional pressure. If only a small amount of force is required from the non-accumulator cylinder 21 then potentially the cylinder 23 could operate in a regen type scenario where the amount of flow is reduced, but the pressure is increased. In the FIG. 12 configuration, the metering valve 66 (see FIG. 13) to the accumulator 30 is removed, reducing the amount of losses that get implemented. This is available because the pressures are separated, and therefore, the accumulator 30 pressure does not need to match a common braking pressure. The decision to use regen or not can be based on for example the operating point and efficiency of the pumps. Re-using energy in this manner can reduce the amount of flow demand from the pump 62 as the accumulator 30 is able to provide up to half of the required flow. This results in less power from the pump 62 and allows a downsizing of the unit.

In the hydraulic systems of FIGS. 11 and 11A, during boom raising the control valve 65 directs hydraulic fluid from the accumulator 30 to both the actuators 21, 23 to power the actuators 21, 23 to raise the boom. In the hydraulic system of FIG. 12, during boom raising the control valve 65 directs hydraulic fluid from the accumulator 30 to the right side (as shown in FIG. 12) actuator 23 to power the actuator 23 to raise the boom. With the FIG. 12 system, the control valve 65 can also, or alternatively, direct hydraulic fluid from the pump 62 to the other actuator 21 (left side as shown in FIG. 12) to raise the boom. For example, the accumulator 30 can provide hydraulic fluid to the actuator 23 at a first pressure and flow, and the pump 62 can provide hydraulic fluid to the actuator 21 at a lower pressure and/or less flow. Thus, in FIG. 12, the accumulator 30 and/or the pump 62 can be used to raise the boom.

In the hydraulic systems of FIGS. 11 and 11A a metering valve 66 is disposed between the control valve 66 and the accumulator 30. This metering valve 66 can also be included in the FIG. 12 hydraulic system between the control valve and accumulator 30 shown in that figure, as will be appreciated. During a boom lowering the metering valve 66 can be used to proportionately meter the hydraulic flow from the piston side(s) of the actuator(s) 21, 23 to the accumulator to control the rate of lowering the boom and/or force on the boom. During a raising of the boom, the metering valve 66 can be used to proportionately meter the hydraulic flow from the accumulator 30 to the piston side(s) of the actuator(s) 21, 23 to control the rate of raising the load implement and/or force on the load implement. In FIG. 12, where the left side actuator 21 is being powered by the pump 62 and the right side actuator 23 is being powered by the accumulator 30, if it desired not to use the entire pressure of the accumulator 30 then valve 66 can be used to reduce that pressure. The pump 62 can be used to control the velocity of the lifting of the boom, using whatever pressure is required.

There may be instances where one cylinder may not be capable of supporting the boom down load without flowing over the relief valves or potentially damaging the cylinder. Shown in FIG. 13, valve 76 provides a connection between the unused cylinder and the rod side areas provides the regen flow as well as a proportional metering orifice 68 to tank. The proportional metering orifice 68 can be used to adjust the actuation pressure. The piston side of the cylinder 23 can be connected to a system to recover the energy such as an over center pump, an accumulator 30 with a metering valve 66 in series, or some combination. The energy recovery cylinder 23 can be used to support the majority of the load to maximize the energy recovery capability of the system. If possible the non-energy recovery cylinder 21 can be in a regen type configuration as this would not require a pump to back fill the rod chamber and the proportional valve connecting the boom and rod side can be used for additional controllability. Using both cylinders 21, 23 to lower the boom 14 in this fashion will increase the range of operating conditions where energy recovery can be accomplished as well as reduce the stress on the boom structure as a smaller moment will be generated. In a further embodiment, a system may be provided where both cylinders 21, 23 are used to recover energy back to the accumulator 30, pump 62, etc., but one could be used as a non-energy recovery cylinder with or without regen when necessary or desired. To operate efficiently, when the accumulator 30 pressure is low, it may not be desirable to boost pressure of the boom cylinders as much (so less metering is required), but as the pressure of the accumulator rises, to continue recovering energy the pressure of the boom can be increased. Many other combinations of the above described methods and configurations are contemplated, as will be appreciated by those skilled in the art.

Figure 14:
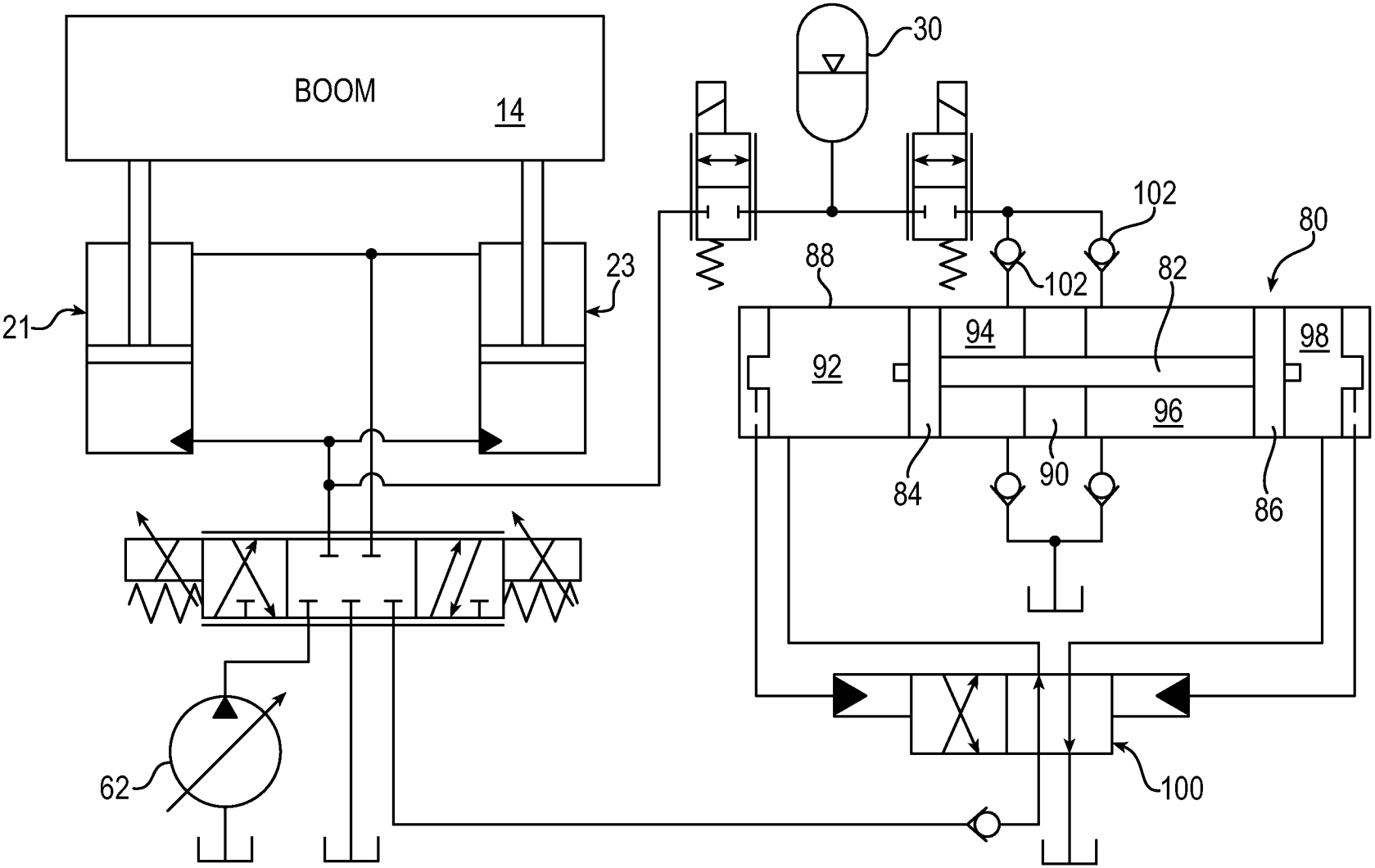
FIG. 14 is a schematic of a linear reciprocating pressure transformer energy recovery configuration for boom recovery.

FIG. 14 illustrates a system which is able to convert the high flow, low pressure exhaust flow to a higher pressure and lower flow rate using a reciprocating linear actuator 80. The low pressure flow will be passively diverted to one of the larger area chambers and the high pressure flow will be exhausted from a chamber with a smaller area. In this sense, the reciprocating linear actuator 80 operates as a hydraulic pressure transformer in that it transforms lower pressure and higher flow rate to higher pressure and lower flow rate. In one form, as shown in FIG. 14, there may be a single shaft 82 with two pistons 84, 86 located inside a cylindrical body 88. A seal 90 can be provided in the center of the cylindrical body 88 to separate the center chamber into two distinct volumes, which forms four chambers 92, 94, 96, 98 that will increase and decrease in volume along with the linear motion of the piston and rods. At the inlet to each of the large chambers is a selector valve 100 that connects the relatively low pressure flow to one of the larger area chambers and connects the other larger area chamber to the tank or zero pressure source. The position of the selector valve 100 can be determined by for example the velocity of the rod 82 and the position of the rod within the cylinder 88. In the illustrated embodiment, for example, the pistons 84, 86 each have a nub that corresponds to notches in the end walls of the cylindrical body 88. When the rod 82 is nearing the end of its stroke, the seating of the nub of a piston with a corresponding notch can create a pilot signal to indicate to the selector valve 100 to switch positions, for example from right box flow patterns to left box flow patterns, thereby to change the direction of the linear actuator 80. In this way, the reciprocating member 82, 84, 86 reciprocates back and forth in the cylindrical body 88 to provide a near continuous amount of flow. Check valves 102 can be provided for connecting each of the chambers to the tanks source so they can fill when the piston is moving in the opposite direction in an effort to be prepared for the next stroke.

The system includes an accumulator 30 on the common line of the low pressure ports of the selector valves. This can be used to minimize the changes in pressure in the exhaust flow from the piston side of the cylinder; without this feature, and depending on the application, the behavior of the cylinder may seem either erratic or uncontrollable.

Referring to the left box flow patterns of the control valve, with the metering valve to the left of the accumulator 30 closed and the metering valve to the right of the accumulator 30 open, as the boom is lowered, hydraulic fluid from the piston sides of the actuators 21, 23 is routed through the lower check valve 102, through the selector valve 100, and to one of the larger area chambers 92, 98 of the reciprocating linear actuator 80. The reciprocating linear actuator 80, in turn, exhausts hydraulic fluid at a relatively higher pressure from the corresponding smaller area chamber 94, 96 through the open right side metering valve and to the accumulator 30. The right side metering valve can be used to meter some of the accumulator pressure to get the desired pressure out of the reciprocating linear actuator 80. Pump flow is routed to the rod sides of the cylinders 21, 23 as back fill. As will be appreciated, the potential energy stored in the accumulator 30 comes from the piston sides of the cylinders 21, 23 via the reciprocating linear actuator 80, and the pressure in the accumulator 30 may be relatively higher or relatively lower than the piston side pressure. If the accumulator 30 is insufficiently charged to raise or assist in raising the boom, then an additional reciprocating linear actuator 80 cycle (or cycles) can be used to recover additional potential energy from another lowering of the boom until the accumulator 30 is sufficiently charged for use.

Of course, if an operator command is to drop the boom faster than the pump 62 can be used to add additional flow to aid in the dropping rate. The pump 62 can provide pump flow to the rod sides of the cylinders 21, 23 to thereby urge the boom to drop faster. This can also facilitate smoother transition for powering into the ground. If the operator command is to power into the ground upon the boom hitting ground, the pump 62 can provide additional pump flow to the rod sides of the cylinders 21, 23 prior to hitting the ground, so that the boom will have standby power to power into the ground. With the standby pressure on the pump 62, once the boom hits the ground digging can be started immediately. Of course, if the operator command is to slow the boom drop rate, the pump flow can be reduced accordingly.

Referring now to the right box flow patterns of the control valve, with the metering valve to the left of the accumulator 30 open and the metering valve to the right of the accumulator 30 closed, to raise the boom, the pump 62 as well as the stored energy in the accumulator 30 pressure both of the piston sides of the actuators 21, 23. The accumulator 30, through the open left side metering valve, adds flow to the flow of the pump 62 at the same pressure. The left side metering valve can be used to meter some of the pump pressure to get the desired pressure out of the accumulator 30. As the accumulator 30 starts to deplete, the pump 62 can provide greater flow. The accumulator 30 can provide flow as it depletes until it meets a certain pressure for example the pressure required to actuate the boom. Once the accumulator 30 reaches such pressure, power can no longer be drawn from the accumulator 30. As such, the left side metering valve is closed and drive can be provided from the pump 62.

Figure 14A:
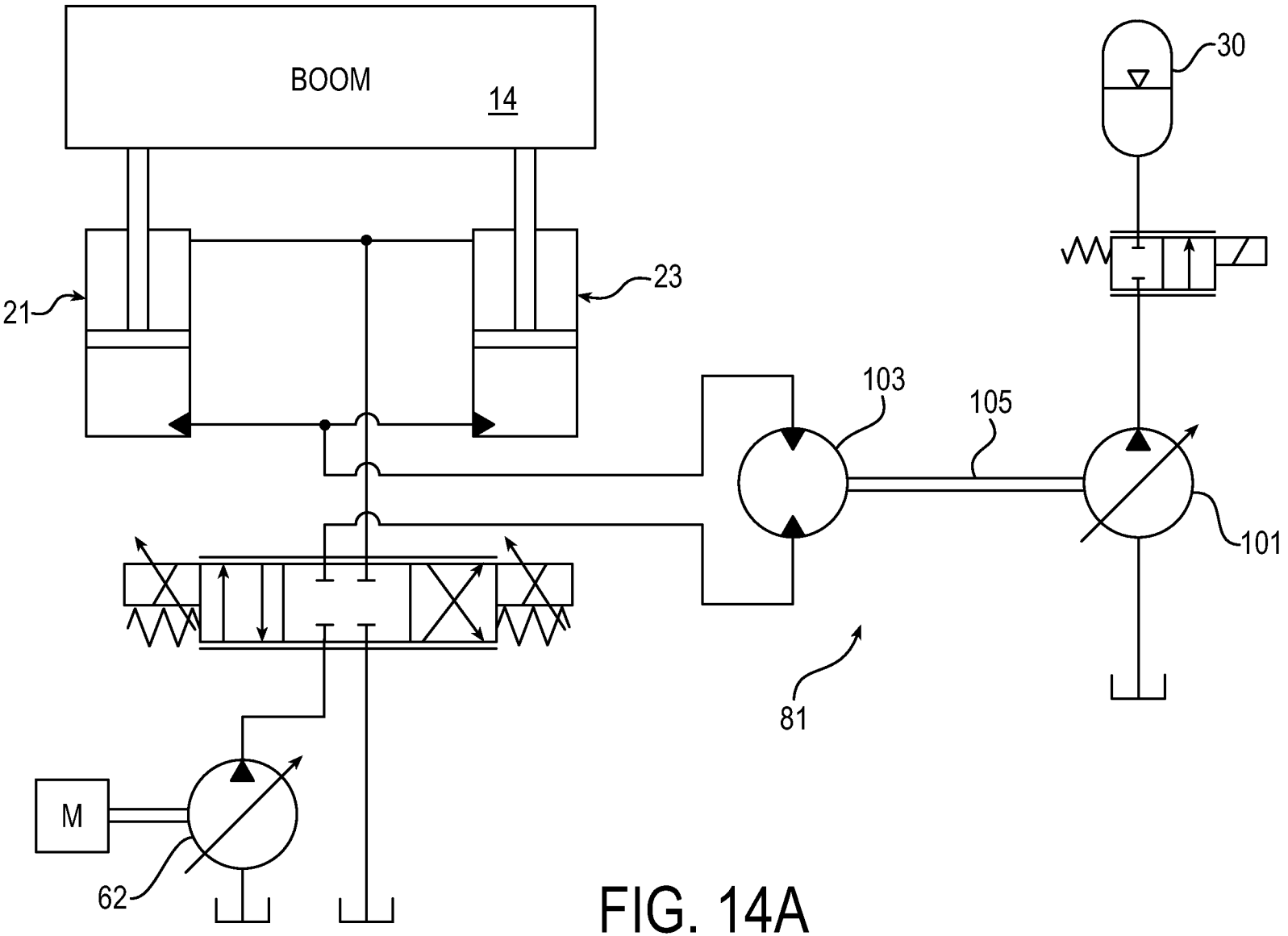
FIG. 14A is a schematic of a rotary pressure transformer energy recovery configuration for boom recovery.

FIG. 14A is a system similar to the FIG. 14 system except the FIG. 14A system replaces the linear reciprocating pressure transformer 80 with a rotary pressure transformer 81. The rotary pressure transformer 80 includes a variable hydraulic pump motor 101 and a bidirectional hydraulic pump motor 103. Depending on the displacement value (positive or negative) and the direction of rotation, the pump motor 101 can work either as a pump or a motor mode. As will be appreciated, the pump motor 103 can be a fixed or variable pump motor 103. The pump motor 101 has an outlet port connected to the accumulator 30 with a proportional valve therebetween, and an inlet port for drawing hydraulic fluid from the tank or other source. The pump motor 101 is connected to the pump motor 103 via a shaft 105. The pump motor 103 has an upper port (as viewed in FIG. 14A) that receives hydraulic fluid from the piston sides of the cylinders 21, 23 during a boom lowering operation and expels pump flow during a boom raising operation. The pump motor 103 has a lower port (as viewed in FIG. 14A) that receives pump flow during a boom raising operation and expels hydraulic fluid during a boom lowering operation.

Referring to the right box flow patterns of the control valve shown in FIG. 14A, with the proportional valve connected to the accumulator 30 open, as the boom is lowered pressurized hydraulic fluid from the piston sides of the actuators 21, 23 is routed to the pump motor 103. The pump motor 103 uses the pressurized fluid to power the motor shaft 105 and then expels the hydraulic fluid through the outlet of the motor 103 to the tank. The motor shaft 105, in turn, powers the pump motor 101 so that the pump motor 101 draws hydraulic fluid from the tank and pressurizes same. The pump motor 101 then supplies the pressurized fluid through the proportional valve and to the accumulator 30 to thereby charge the accumulator 30. In other words, potential energy of the load, here provided by the boom descent, is transferred to the accumulator 30. As in the FIG. 14 system, the variable displacement pump 62 can provide pump flow to the rod sides of the cylinders 21, 23 as back fill. As will be appreciated, the potential energy stored in the accumulator 30 comes from the piston sides of the cylinders 21, 23 via the rotary pressure transformer 81, and the pressure in the accumulator 30 may be relatively higher or relatively lower than the piston side pressure. If the accumulator 30 is not sufficiently charged to raise or assist in raising the boom, then an additional rotary pressure transformer 81 cycle (or cycles) can be used to recover additional potential energy from another lowering of the boom until the accumulator 30 is sufficiently so charged.

Of course, if an operator command is to drop the boom faster then the pump 62 can be used to add additional flow to aid in the dropping rate. The pump 62 can provide pump flow to the rod sides of the cylinders 21, 23 to thereby urge the boom to drop faster. This can also facilitate smoother transition for powering into the ground. If the operator command is to power into the ground upon the boom hitting ground, the pump 62 can provide additional pump flow to the rod sides of the cylinders 21, 23 prior to hitting the ground, so that the boom will have standby power to power into the ground. With the standby pressure on the pump 62, once the boom hits the ground digging can be started immediately. Of course, if the operator command is to slow the boom drop rate, the pump flow can be reduced accordingly.

Referring now to the left box flow patterns of the control valve, with the proportional valve connected to the accumulator 30 open, to raise the boom, the accumulator 30 provides pressurized hydraulic fluid to the pump motor 101. The pump motor 101 uses the pressurized fluid to power the motor shaft 105 and then expels the hydraulic fluid through the outlet of the pump motor 101 to the tank. The motor shaft 105 drives the motor pump 103. The motor pump 103, in turn, draws hydraulic fluid from the tank via the pump 62 and control valve, pressurizes the flow, and provides the pressurized flow to the piston sides of the actuators 21, 23 thereby raising the boom. The pump 62 can also provide pressurized flow to the piston sides of the cylinders 21, 23 via the control valve and pump motor 103, to raise or assist in raising the boom. In other words, both the pump 62 and the pump motor 103 can be used to lift the boom, in a manner similar to a two stage pump for example. The accumulator 30 can provide flow as it depletes until it meets a certain pressure for example the pressure required to actuate the boom. Once the accumulator 30 reaches such pressure, power can no longer be drawn from the accumulator 30. As such, the accumulator proportional valve can be choked off and drive can be provided from the pump 62.

The illustrated hydraulic systems of FIGS. 14 and 14A each have two hydraulic actuators 21, 23. The hydraulic system need not be limited as such. As noted earlier, and as will be appreciated, one or more hydraulic actuators may be connected between the machine frame and the moving parts of an implement such as the boom 14. Thus, in FIGS. 14 and 14A, the hydraulic system may include a single actuator instead of two actuators.

The several embodiments herein enable utilizing recovered energy. The energy from the boom or swing can be reused in a number of different ways. If used immediately it can be directed towards a pump or if it is captured to an accumulator it can be directed to either the boom or the swing drive. It is also possible to combine one or more of the methods described herein to efficiently use the energy. In some cases, sacrifices to efficiency gains can be made to create smooth operation. Metering valves for example can be wasteful but very smooth in their operation and thus can facilitate this. A variable displacement pump/motor can also be used, but in certain displacement ranges, the volumetric efficiency of the motor for a means of energy transfer may be lower than a route using metering valves and an accumulator. Because of this, it will be appreciated that sizing of components can be done based on the most common operating modes for higher efficiencies, allowing for lower efficiencies at deviations from those averages.

If the flow energy is to be used immediately the flow can be diverted back to the pump/motor or to a separate motor. If an over-center pump is used in the system, the power can be added back to the engine shaft to assist other functions. Alternatively, if the pumps are configured to handle it, the flow can be directed back to the inlet of the pump. This can reduce the increase in pressure required to obtain the working pressure at the outlet which will reduce the amount of torque required to spin the pump. The torque required for a pump may be proportional to the delta in pressures across the pump trying to be generated. Another option is to distribute the hydraulic energy immediately to another function that is demanding flow by incorporating suitable valving. As will be appreciated, such valving may be more significant than the afore described configurations, but the efficiency in general should be higher as there are less energy conversions required to get it to work. Efficiency losses from metering may not play a large role if the pressures are close together. However, if the energy from the boom and swing motor are stored to an accumulator the energy may be used in a different manner than described above.

Figure 15:
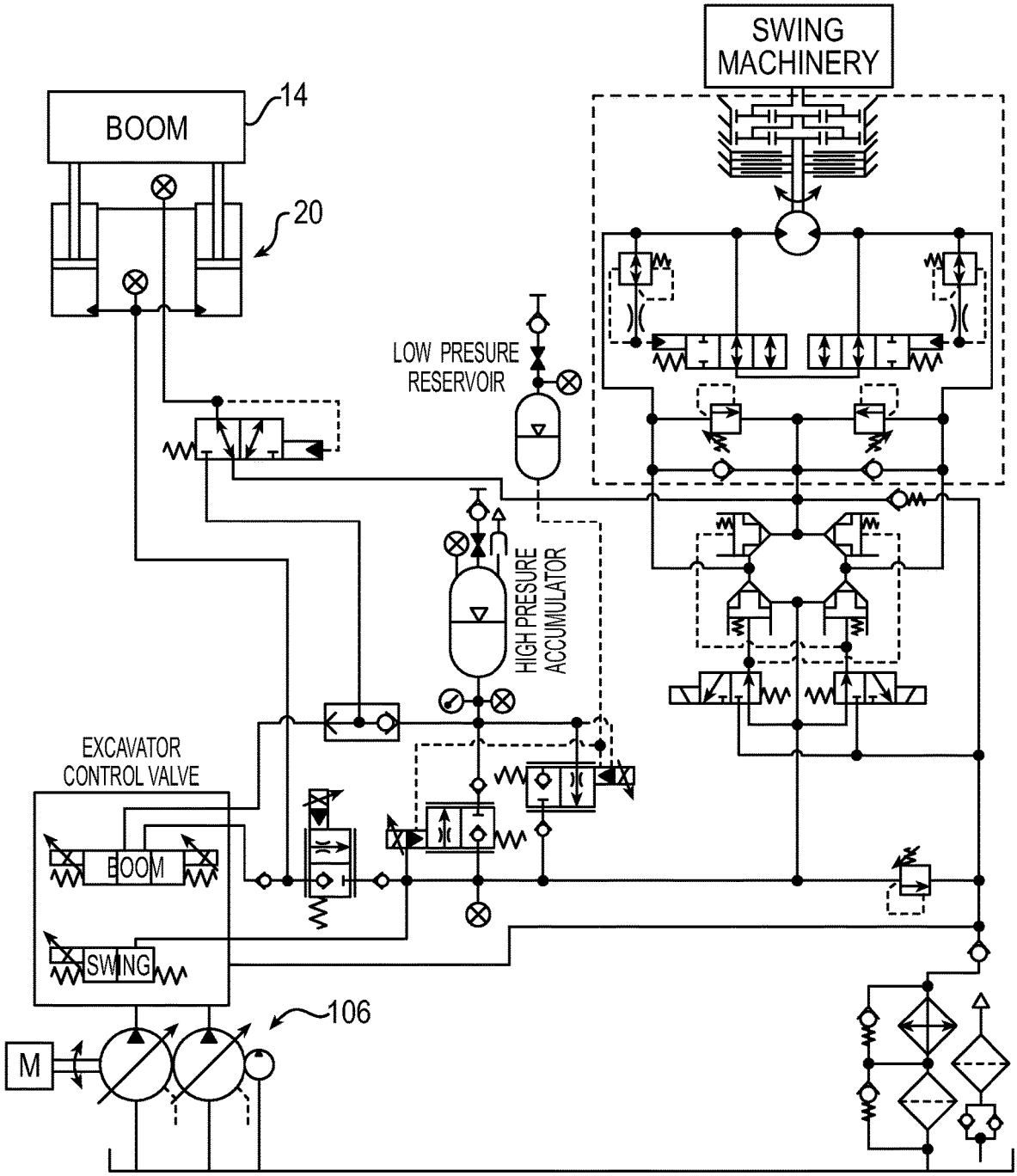
FIG. 15 is a boom/swing recovery circuit with a single accumulator and using stock pumps.

If the energy stored in the accumulator 30 is used to power the swing drive 25 a system similar to that described in co-owned international published patent application WO 2014120930 A1, entitled "Hydraulic hybrid swing drive system for excavators" filed Jan. 30, 2014—incorporated herein by reference, can be used. In this system the accumulator is connected in series with a proportional metering valve to the swing drive. The proportional metering valve can be used to generate the required pressure drop from the accumulator to the desired working pressure of the swing motor; from a basic perspective the opening of the proportional metering valve can be based upon the required pressured drop and the flow to the swing motor. In the referenced international patent application there is an additional dedicated swing pump added to the system to decouple the swing function from the stock system. However, it is also possible to power the swing drive from the accumulator and the stock pump on the excavator; if the boom and swing energies are recovered back to the accumulator then the efficiency of this system can be expected to not be much worse, if not better, than the system described in the referenced international patent application. If a dedicated swing pump is not included the accumulator can power the swing drive until the pressure in the accumulator is not sufficient to meet the performance requirements or the swing drive is operating at a lower pressure where it is inefficient to use the accumulator. When the accumulator is deemed to be unusable either for performance, efficiency, or other reasons the stock pump can operate as normal and provide flow to the swing drive. With a properly sized accumulator, the swing function can behave nearly as if it is decoupled from the other functions. An example of this configuration is shown in FIG. 15.

Figure 16:
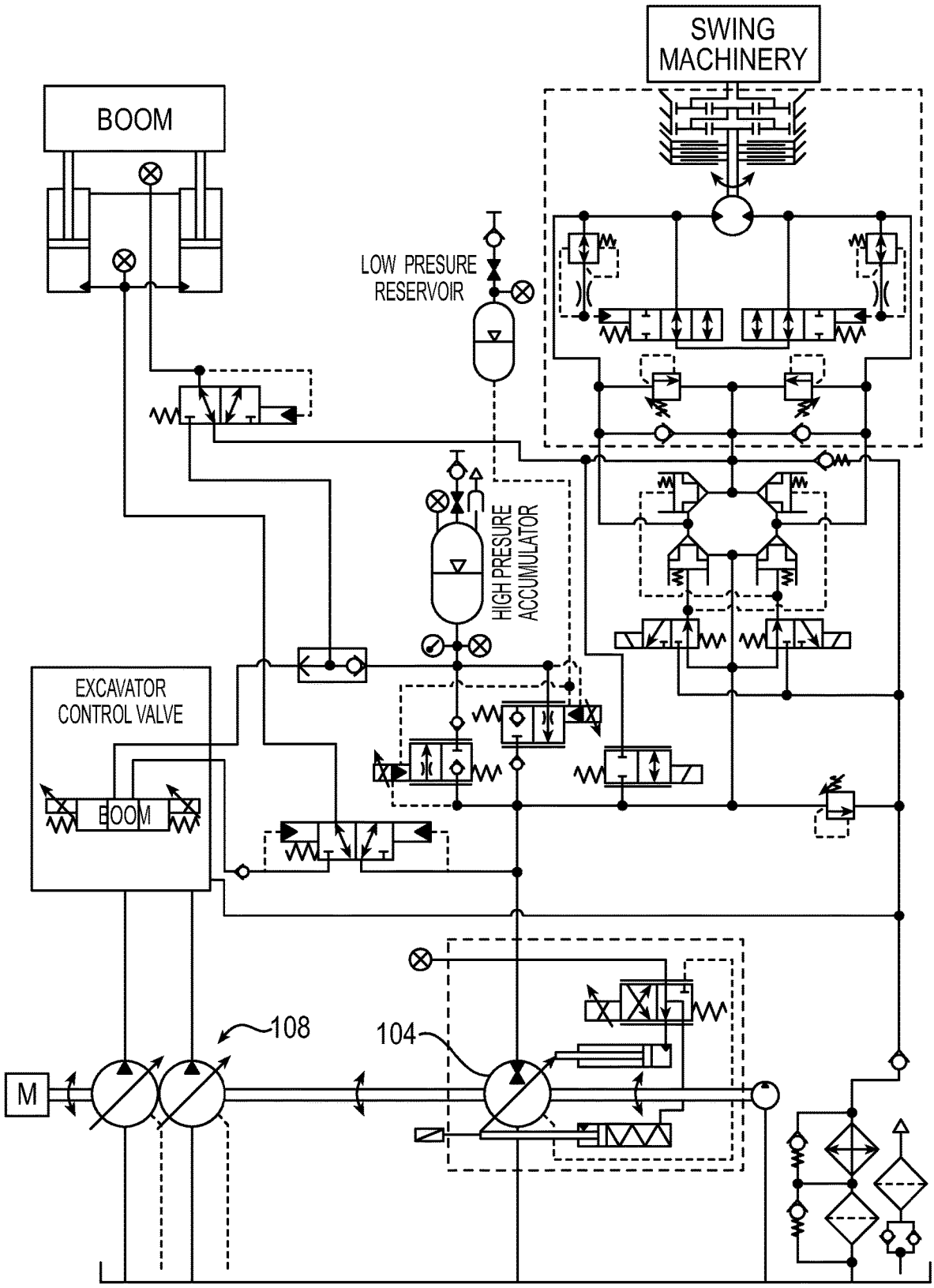
FIG. 16 is a boom/swing recovery circuit with a single accumulator and using stock pumps and an additional pump/motor.

The swing and boom recovery systems on the same vehicle can be combined. The two systems can have different actuation pressures, as well as pressure applied at different times. Recovery from the boom can be via use of an accumulator, where the pressure in lowering and the pressure to raise is usually the same. Accumulators can be charged to a higher pressure; to create a constant braking pressure, a metering orifice can be used to make the difference between the cylinder pressure and the accumulator pressure. The accumulator can be sized to make the end of recoverable energy be at a pressure equal to the braking pressure, decreasing the amount of metering required. Then to use the energy stored in the accumulator, it can be at a lower pressure with a metering orifice to create a constant pressure for accelerating and the accumulator can be considered near empty close to this acceleration pressure. Since boom recovery relies on gravity to push the boom down to create pressure which can be stored as potential energy, generally the rod side of the boom cylinders can be kept at low pressure and allow the gravity to directly create that without adding energy to the system. Because of this, when the bucket makes contact with the ground, a low pressure is seen there, so it will stop recovering, but it may not be able to dig until it is realized that pressure from the pumps needs to be supplied and then reaction time from valves and pumps also delays this an unsatisfactory amount. Two different methods can be used to alleviate this problem, one of which is to sense an oncoming ground reaction through optical or auditory sensors showing distance to the ground. Cylinder position sensors could potentially also be used, but this is less reliable and may have false negatives unnecessarily. Another way, which mimics what the stock vehicle does, is to provide standby fluid energy which can power the cylinders down once it makes contact. In the stock machine, the boom can be powered down at a low pressure and large flow, which equates to a relatively low pressure, but if another function is being used, then the pump requires a pressure to be generated, which then requires a pressure drop either through a meter out orifice or through a meter in orifice on the boom in order to provide the necessary or desired flow and pressure to the cylinder. This can be wasteful, and thus bypassing this may be desirable. Instead of using a pump, a standby pressure can be used for example from the high pressure accumulator, which is not wasteful. The pressure in the accumulator is static, so having pressure ready to be used when required does not waste energy. Once the accumulator pressure is used, pressure sensors can sense this shift and the pumps and valves can be actuated so that they provide the energy for digging. The accumulator can simply provide a transition high pressure while the pumps and valves get into position before they are able to contribute so that the transition from recovery lowering and powered digging is transparent to the user. This figure shows one such configuration using a shuttle valve and a priority valve to provide the passive circuit which will allow for this pressure transition to occur. FIG. 16 shows an additional configuration using an extra pump 104 to the stock pump system 108 allowing for higher efficiencies.

As will be appreciated, flow demand for the swing drive and energy loss due to metering or inefficient operating points may affect the suitability of a motor and/or cylinder. The swing drive is operated by a motor which can rotate an infinite number of rotations and therefore is unlimited in the amount of flow it can demand. This is dissimilar to a cylinder, which powers the boom, arm, and bucket functions, where the volume of flow is limited based on the working area of the cylinder and the length of stroke. Sizing an accumulator for the movement of a cylinder is in some respects less difficult than sizing it for a motor due to the bounding of the volume of flow. General operation of a swing drive usually does not exceed 180 degrees of rotation because the swing drive can rotate in the opposite direction over a shorter rotation to reach the same desired position. Most operations for an excavator are either a 90 degree operation or a 60 degree operation. Additionally, the average operating efficiency of a motor is in the range of 82% (or even lower at some undesirable operating points) whereas the efficiency of a cylinder is >95% as there is virtually no volumetric loss and small amount of mechanical inefficiency due to friction. This difference in efficiency suggests a cylinder solution may be desirable.

One embodiment to reuse the stored energy in the accumulator with the boom system is to direct the stored accumulator energy towards both boom cylinders. The force in the vertical direction can be controlled by a suitable technique for example by metering the energy. Additionally, for such a system, if the motion stops the pressure in both cylinders may equal the accumulator pressure. When the pressure in the accumulator is depleted to such a level where the boom can no longer be lifted the stock pumps can be used to provide the required flow and pressure.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hydraulic boom recovery system for a mobile construction vehicle, comprising:

a boom;

a cylinder for powering the boom;

an accumulator that is configured to recover potential energy from the cylinder pressure from the lowering of the boom;

a pump that is configured to supply pressure to the cylinder; and a sensor that is configured to sense an oncoming ground reaction between the boom and the ground;

wherein, in response to the sensed reaction, the accumulator stops recovering and the pump provides pressure to the cylinder for the boom to dig into the ground.

2. The hydraulic boom recovery system of claim 1, wherein the sensor includes one of an optical sensor, a proximity sensor, an auditory sensor, or a position sensor.

3. The hydraulic boom recovery system of claim 1, wherein the pump is configured to supply pressure to the cylinder prior to the boom digging into the ground.

4. A hydraulic boom recovery system for a mobile construction vehicle, comprising:

a boom;

a cylinder for powering the boom;

an accumulator that is configured to recover potential energy from the cylinder pressure from the lowering of the boom and to provide a transition pressure to power the cylinder down for a dig once the boom makes contact with the ground;

a pressure sensor to sense a shift that pressure in the accumulator is being used to provide the transition pressure to the cylinder for a dig; and pumps and valves that are configured to actuate to provide energy for digging in response to the sensed shift that pressure in the accumulator is being used to provide the transition pressure to the cylinder for a dig.

5. The hydraulic boom recovery system of claim 4, wherein the accumulator is configured to provide the transition pressure while the pumps and valves get into position before they are able to contribute to a dig.

6. The hydraulic boom recovery system of claim 4, further comprising a hydraulically actuated valve that is configured to provide the transition pressure from the accumulator to the cylinder for a dig in response to the boom making contact with the ground.

7. The hydraulic boom recovery system of claim 6, wherein the hydraulically actuated valve includes a priority valve connected to the accumulator that is configured to open the accumulator upon a pressure spike from the boom hitting the ground.

8. The hydraulic boom recovery system of claim 7, wherein the hydraulically actuated valve includes a shuttle valve that is configured to shift from one position at which the accumulator provides pressure to the cylinder for digging to another position at which it blocks the accumulator from providing pressure and allows a pump to start providing pressure to the cylinder for digging.

9. The hydraulic boom recovery system of claim 6, wherein the hydraulically actuated valve includes a shuttle valve that is configured to shift from one position at which the accumulator provides pressure to the cylinder for digging to another position at which it blocks the accumulator from providing pressure and allows a pump to start providing pressure to the cylinder for digging.

10. A method of recovering potential energy of a load implement of a mobile construction vehicle, comprising:

using a cylinder for powering a boom;

using an accumulator to recover potential energy from cylinder pressure from lowering of a boom;

using a pump to supply pressure to the cylinder; and using a sensor to sense an oncoming ground reaction between the boom and the ground;

wherein, in response to the sensed reaction, stopping the recovering by the accumulator and using the pump to provide pressure to the cylinder for the boom to dig into the ground.

11. The method of claim 10, wherein the using the sensor includes using one of an optical sensor, a proximity sensor, an auditory sensor, or a position sensor.

12. The method of claim 10, wherein the using the pump includes supplying pressure to the cylinder prior to the boom digging into the ground.

* * * * *